US005286915A

United States Patent [19]

Komano et al.

[11] Patent Number: 5,286,915

[45] Date of Patent: Feb. 15, 1994

[54] ELECTRONIC MUSICAL INSTRUMENT WHICH SIMULATES PHYSICAL INTERACTION OF PIANO STRING AND HAMMER

[75] Inventors: Takeshi Komano; Toshifumi Kunimoto, both of Hamamatsu, Japan

[73] Assignee: Yamaha Corporation, Hamamatsu, Japan

[21] Appl. No.: 857,628

[22] Filed: Mar. 25, 1992

[30] Foreign Application Priority Data

Mar. 29, 1991 [JP] Japan ..... 3-091565

[51] Int. Cl.[5] ..... G10H 1/12; G10H 1/18

[52] U.S. Cl. ..... 84/658; 84/661; 84/DIG. 7; 84/DIG. 9; 84/DIG. 10

[58] Field of Search ..... 84/615, 626, 658, 687-690, 84/622-625, 661, 699, 700, 736, DIG. 7, DIG. 9, DIG. 10

[56] References Cited

U.S. PATENT DOCUMENTS 4,899,631 2/1990 Baker ..... 84/DIG. 7

OTHER PUBLICATIONS

"Piano Tone Synthesis Using Digital Filters By Computer Simulation", Isao Nakamura, Soichiro Iwaoka, ICASSP 86, Tokyo, pp. 1293-1296.

"Application of Digital Filters To Vibration of Piano Strings Having Interaction", pp. 373-374.

"Foundation of Digital Signal Processing", pp. 129-134.

"Longitudinal Vibration and Inharmonic Tone of Piano String", Takeshi Yanagisawa, Kijuro Nakamura, Isao Shirayanagi; The Journal of the Acoustical Society of Japan, vol. 33, No. 8 (Aug. 1977) pp. 412-416.

*Primary Examiner*—Stanley J. Witkowski

*Attorney, Agent, or Firm*—Graham & James

[57] ABSTRACT

An electronic musical instrument for realizing touch at the time of the manipulating of a manipulator such as a keyboard faithfully reflected on the resulting musical tone. The electronic musical instrument has acceleration pickups respectively attached to keys in the keyboard, and tone synthesizing portions respectively driven on the basis of signals obtained by integrating acceleration detection signals outputted from the acceleration pickups.

15 Claims, 19 Drawing Sheets

ELECTRONIC MUSICAL INSTRUMENT WHICH SIMULATES PHYSICAL INTERACTION OF PIANO STRING AND HAMMER

BACKGROUND OF THE INVENTION

1. Field of the Invention

The present invention relates to an electronic musical instrument and particularly relates to a keyboard electronic musical instrument.

2. Description of the Related Art

A keyboard is most general as means for manipulating the electronic musical instrument. That is, a keyboard is an excellent manipulating means which can be easily operated by a performer and, at the same time, can be easily matched with expression of a feeling. Heretofore, a keyboard electronic musical instrument in which a detection signal corresponding to touch at the time of the depressing of a key in the keyboard is generated to thereby control the strength of the musical tone, is known.

On the other hand, various tone synthesizers having an electric or software model for physically simulating the tone generating mechanism of a natural musical instrument and using the operation of the model have been proposed. If a detection signal generated by the depression of a key is given to this type tone synthesizer, a keyboard electronic musical instrument suitable for musical performance richer in reality can be provided.

To improve representation as a musical instrument, it is necessary that touch at the time of the performer's depressing of a key is faithfully reflected on the resulting tone. FIG. 41 shows a schematic structure (corresponding to one key) related to the detection of key depression in a conventional keyboard electronic musical instrument. As shown in FIG. 41, two switches SW1 and SW2 for detecting key depression are attached to each key KEY supported by a fulcrum in the keyboard. When the key KEY is depressed to a first depth, the switch SW1 is turned on. When the key KEY is depressed to a second depth which is deeper than the first depth, the switch SW2 is turned on.

When the switches SW1 and SW2 are successively turned on by depressing the key KEY, the time difference between the turning-on of the switch SW1 and the turning-on of the switch SW2 is counted by a time difference detecting circuit DET. A key velocity signal corresponding to the key-depressing velocity of the key KEY is generated on the basis of the count result. Then, the strength of the tone to be generated in the tone generator TG is controlled by a central processing unit (CPU) 1 on the basis the key velocity signal.

SUMMARY OF THE INVENTION

An object of the present invention is to provide an electronic musical instrument in which touch at the time of the performance thereof can be faithfully reflected on the resulting musical tone.

According to an aspect of the present invention, there is provided an electronic musical instrument comprising a manipulator manipulated by a performer, an acceleration detector means for generating an acceleration signal corresponding to acceleration acting on the manipulator, an integration means for generating a velocity signal calculated by integrating the acceleration signal with respect to time, and a tone synthesizer means for synthesizing a musical tone on the basis of the velocity signal.

According to the aforementioned configuration of the present invention, the musical tone can be generated correspondingly to impulse given to the manipulator, so that the electronic musical instrument can be improved in artistic presentation at the time of the performance thereof.

Consequently, the touch at the time of the performer's manipulating of the manipulator can be faithfully reflected on the resulting musical tone, so that the electronic musical instrument can be improved in artistic presentation at the time of the performance thereof.

DESCRIPTION OF THE PREFERRED EMBODIMENTS

The action of the piano as a natural musical instrument is achieved by transforming impulse given to a key by a performer into hammer velocity. The impulse can be approximated as represented by the expression $\int f dt = \int m\alpha dt = m\int \alpha dt = mv_f$ in which: m represents the mass of the key; $\alpha$ represents acceleration given to the key by force f; and $v_f$ represents the final velocity of the key. That is, the final velocity $v_f$ is important. If touch is controlled correspondingly to the interval required for the passage of the key KEY between two points, expression of delicate touch as obtained by actually playing the piano cannot be obtained. Accordingly, actual key depressing velocity cannot be measured accurately, so that it is difficult for the performer to adjust tone strength. This problem will be described hereunder with reference to FIG. 42.

Figure 42:
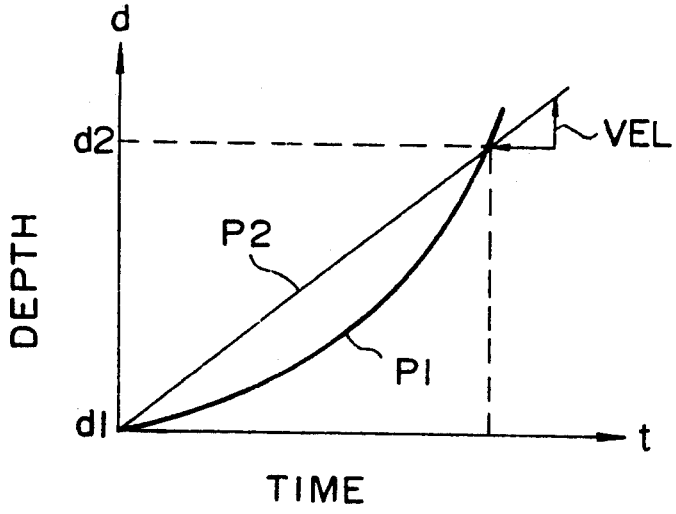
FIG. 42 is a graph for explaining a problem in the conventional keyboard electronic musical instrument.

In FIG. 42, the abscissa represents a time axis, and the ordinate represents the depth d of a depressed key KEY. In the ordinate, d1 represents the depth of the key KEY for turning a switch SW1 on, and d2 represents the depth of the key KEY for turning another switch SW2 on. In FIG. 42, the curve P1 shows the actual change with the passage of time, of the depth of the key KEY in the case where the key is depressed. The line P2 is formed by connecting a point for d=d1 and a point for d=d2 on the curve P1. The gradient of the line P1 corresponds to the key velocity VEL measured by the aforementioned conventional method. As shown in FIG. 42, it is apparent that error arises between the final velocity (the gradient of the curve P1 at the point for d=d2) of the key KEY and the key velocity signal VEL. In the case of the aforementioned conventional method, musical tones different in key depressing intensity are generated as the same touch if there is no change of the time difference between the timing of turning the switch SW1 on and the timing of turning the switch SW2 on.

Accordingly, a faint tone can be generated by the piano as a natural musical instrument when a key is depressed rapidly and faintly, whereas a strong tone is generated by the conventional keyboard electronic musical instrument when the instrument is played rapidly. This is because the conventional keyboard electronic musical instrument is mistaken in recognizing the touch as intensive touch. Further, in the conventional keyboard electronic musical instrument, a tone of fainter touch than the actual touch is generated when the instrument is played strongly.

Embodiments of the present invention will be described hereunder with reference to the drawings.

Figure 1:
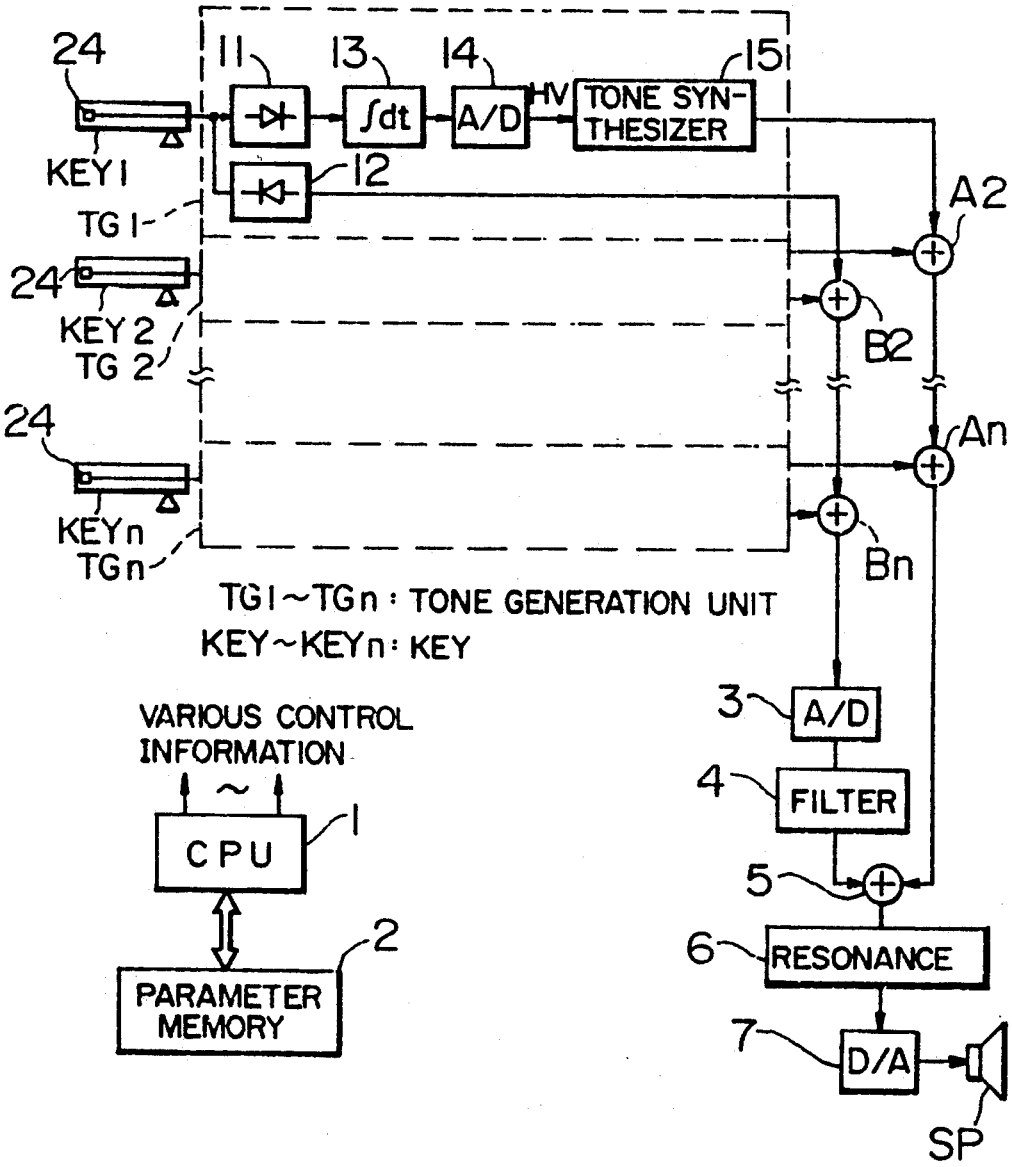
FIG. 1 is a block diagram showing an example of the basic structure of a keyboard electronic musical instrument as an embodiment of the present invention.

FIG. 1 is a block diagram showing the basic structure of a keyboard electronic musical instrument as an embodiment of the invention. A central processing unit (CPU) 1 reads control parameters from a parameter memory 2 as occasion demands, and supplies control information to respective portions of the electronic musical instrument. Keys KEY1 to KEYn nare provided on a keyboard and have acceleration pickups 24 respectively attached at front portions thereof. Key depression detecting/tone synthesizing portions TG1 to TGn respectively generate tone signals in response to the operation of depressing the keys KEY1 to KEYn.

Each of the key depression detecting/tone synthesizing portions TG1 to TGn has half-wave rectification circuits 11 and 12, an integration circuit 13, an analog/digital (A/D) converter 14, and a tone synthesizing portion 15. The half-wave rectification circuit 11 receives an acceleration detection signal from a corresponding acceleration detection pickup 24 and selects the positive components thereof as an output signal. The positive components are integrated by the integration circuit 13. The integration result is converted into a digital signal by the A/D converter 14. The output digital signal from the A/D converter 14 is supplied to the tone synthesizing portion 15 so that the signal can be used as a hammer velocity signal HV corresponding to the velocity of a hammer in the piano.

In the tone synthesizing portion 15, a tone signal is synthesized on the basis of the hammer velocity signal HV. Tone signals respectively synthesized by the tone synthesizing portions 15 in the key depression detecting/tone synthesizing portions TG1 to TGn are added by adders A2 to An, so that the resulting tone signal is given to one input terminal of an adder 5.

On the other hand, each of the half-wave rectification circuits 12 in the key depression detecting/tone synthesizing portions TG1 to TGn selects the negative components of the acceleration detection signal and generates a signal corresponding to acceleration (which may be also considered as acceleration received by a stopper which is a wood portion provided under the keyboard) received by the keyboard in the case where a key strikes on the stopper.

Output signals from the half-wave rectification circuits 12 are added by adders B2 to Bn. The resulting signal is converted into a digital signal by an A/D converter 3. The output signal from the A/D converter 3 is given to a filter 4 for approximating factors such as the frame of the piano. A signal equivalent to so-called mechanical noise is generated from the filter 4 and given to the other input terminal of the adder 5.

The sum of the output signals from the tone synthesizing portions 15 and the output signal from the filter 4 are added by the adder 5. The addition result is passed through a resonance circuit 6 for simulating factors such as the frame of the piano, the sound-board of the piano, etc., and then converted into an analog signal by a digital/analog (D/A) converter 7. The analog signal is supplied to a speaker SP, so that a musical tone is generated.

The detailed structure and operation of the respective portions of the keyboard electronic musical instrument will be successively described hereunder.

STRUCTURE OF CIRCUIT RELATED TO DETECTION OF KEY DEPRESSION

Figure 2:
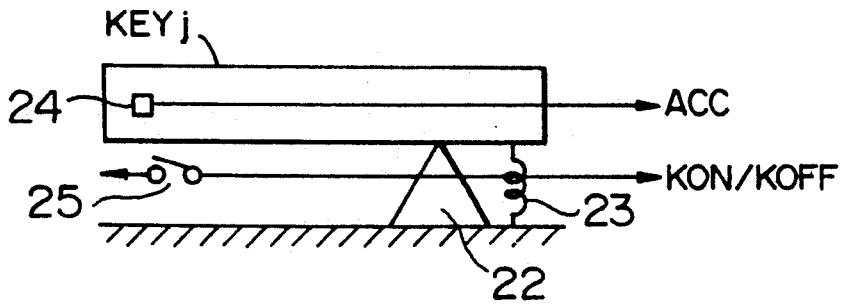
FIG. 2 is a diagram showing an example of the structure of a key KEYj in this embodiment of the invention.

The structure of a mount portion of a key KEYj (j=1 to n) in the keyboard electronic musical instrument is shown in FIG. 2. As shown in FIG. 2, the key KEYj is mounted on the keyboard so that the key can be turned about a fulcrum 22. The key KEYj has an acceleration pickup 24 attached at an end portion which can be depressed by the performer. An example of the acceleration pickup used in this invention is a combination (space) of an actuator of a predetermined weight and a pressure sensor such as a semiconductor distortion gauge. A spring 23 is attached to the key KEYj at an end portion opposite to the end portion which can be depresses by the performer. By the spring 23, moment is provided to lift up the end portion depressed by the performer. The spring 23 may be replaced by a weight. The acceleration pickup 24 can be attached at a suitable position as long as the position is adequately far from the fulcrum 22. An equivalent acceleration detection signal ACC can be formed by weighting corresponding to the distance from the fulcrum 22, regardless of the position at which the acceleration pickup is attached. It is however preferable that the acceleration pickup 24 is attached at the end portion in order to detect acceleration more accurately.

Further, a switch 25 is provided under the end portion of the key KEYj. When the key KEYj is depressed by a predetermined depth, the switch 25 is turned on to generate a key switch signal KON/KOFF corresponding to the ON/OFF state of the switch 25. The key switch signal KON/KOFF is used as a trigger for instructing the integration circuit 13 to fetch the acceleration detection signal ACC and start the integrating operation and as a trigger for synthesizing a musical tone in the tone synthesizing portion 15. Accordingly, the key switch signal KON/KOFF must be outputted without any delay from the key depressing operation, so that the switch 25 is preferably attached at a shallow position as possible.

Figure 3:
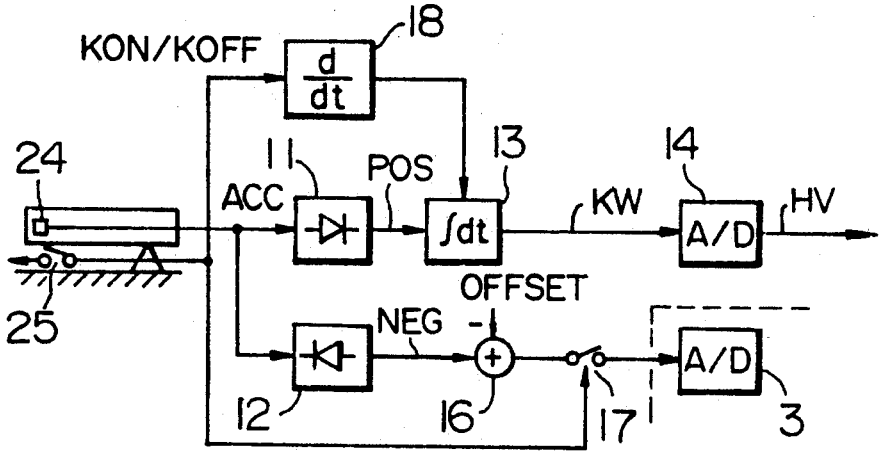
FIG. 3 is a block diagram showing an example of the structure of a portion related to the detection of key depression in this embodiment of the invention.
Figure 4:
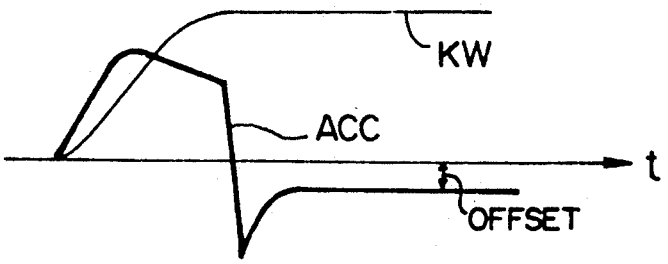
FIG. 4 is a waveform graph showing signal waveforms at respective points in FIG. 3.

FIG. 3 shows an example of the detailed structure of the circuit for processing the acceleration detection signal ACC outputted from the acceleration pickup 24. A subtracter 16, a switch 17 and a differentiator 18 which are not shown in FIG. 1 are shown in FIG. 3. The positive components POS (corresponding to the downward movement of the key KEYj) of the acceleration detection signal ACC are extracted by passing the acceleration detection signal ACC through the half-wave rectifier 11 and given to the integrator 13. When the KEYj is depressed, the switch 25 is turned on to start the key switch signal KON/KOFF. The starting of the key switch signal KON/KOFF is detected by the differentiator 18, so that a trigger signal is delivered from the differentiator 18 to the integrator 13 to start the integrating operation in the integrator 13. The integration waveform KW from the integrator 13 is sequentially converted into a digital signal by the A/D converter 14. The digital signal is supplied, as a hammer velocity signal HV, to the tone synthesizing portion 15. When the depressed key KEYj is then released, the switch 25 is turned off to stop the key switch signal KON/KOFF. The stopping of the key switch signal KON/KOFF is detected by the differentiator 18, so that the integrator 18 is reset by the differentiator 18 to wait for the next key depressing operation. FIG. 4 shows the acceleration detection signal ACC outputted from the acceleration pickup 24 and the output waveform KW from the integrator 13.

Although acceleration ACC increases rapidly at an initial stage, it decreases after it reaches a peak. When the key reaches the stopper, the acceleration decreases so rapidly that the key receives negative acceleration because of the rebound. Finally, the acceleration takes a predetermined value OFFSET. Acceleration having a smaller value than the value OFFSET is neglected. A waveform KW is obtained by integrating the aforementioned acceleration signal with respect to time.

On the other hand, the negative components NEG of the acceleration signal ACC are extracted by passing the acceleration signal ACC through the half-wave rectifier 12. The offset OFFSET equivalent to the moment caused by the spring (or weight) is subtracted from the negative components NEG by the subtracter 16, the resulting signal is delivered to the mechanical noise generating filter 4 (FIG. 1) through the switch 17, adders B2 to Bn (FIG. 1) and A/D converter 3. When the key switch signal KON/KOFF is stopped by releasing the key KEYj, the switch 17 is turned off so that the signal supply to the filter 4 is terminated or in other words the generation of mechanical noise is terminated.

In FIGS. 1 and 3, the A/D converter 14 does not require high accuracy. Accordingly, the provision of A/D converters corresponding to the number of the keys as shown in FIG. 1 may be replaced by the provision of one A/D converter for applying A/D conversion to integration waveforms KW corresponding to the keys by way of time division. When, for example, the keyboard has 88 keys, the sampling frequency of the A/D converter 14 may be set to 88 kHz so that the integration waveforms KW corresponding to the keys are respectively subjected to A/D conversion in time slots obtained by dividing the sampling period into 88 parts. By this method, a hammer velocity signal HM having the sampling frequency of 1 kHz can be obtained for each key.

According to the aforementioned structure, a hammer velocity signal HM faithful to touch at the time of key depression can be obtained. FIGS. 5A to 5D show output signals POS from the half-wave rectifier 11 and integration waveforms KW from the integrator 13 in typical touches.

Figure 5A:
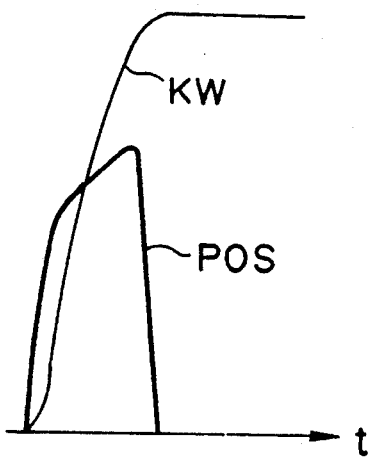
FIGS. 5A through 5D are waveform graphs showing signal waveforms in the case where various kinds of key touches are applied to the depression of a key in this embodiment of the invention.

FIG. 5A shows waveforms in the case where a key is depressed speedily and strongly. In this case, a large quantity of acceleration continuously acts on the key KEYj in a period from the point of time when the depression of the key is started to the point of time when the key collides with the stopper. Accordingly, the integration waveform KW from the integrator 13 increases up to a large value, so that a large hammer velocity signal HV is supplied to the tone synthesizing portion 15.

Figure 5B:
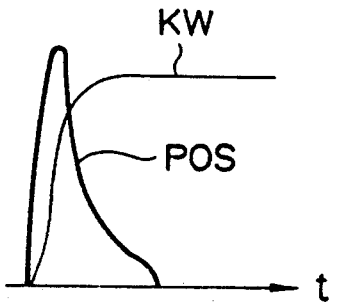

FIG. 5B shows waveforms in the case where a key is depressed speedily and faintly. In this case, the acceleration signal ACC increases up to a large value but impulse given to the key KEYj is small, so that the acceleration signal ACC decreases to a small value after it reaches a peak. Accordingly, the final value of the integration waveform KW becomes small, so that the hammer velocity signal HV becomes small.

Figure 5C:
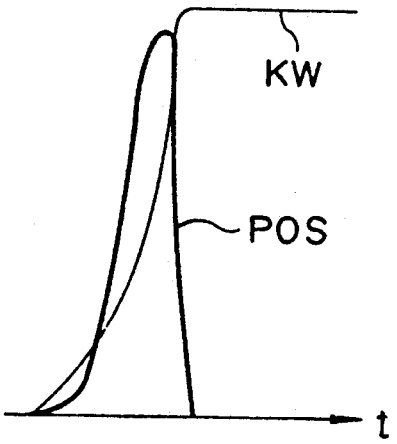

FIG. 5C shows waveforms in the case where a key is depressed slowly and strongly. In this case, the acceleration signal ACC increases up to a small value but impulse given to the key KEYj is large. Accordingly, the integration waveform KW increases to a large value, so that the hammer velocity signal HV becomes large.

Figure 5D:
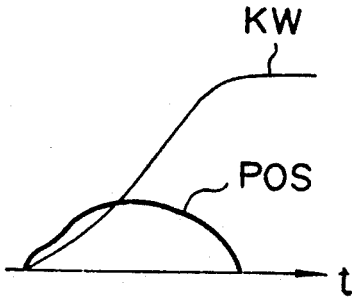

FIG. 5D shows waveforms in the case where a key is depressed slowly and faintly. In this case, the value of the acceleration signal ACC is continuously small, so that the hammer velocity signal becomes small.

As described above, a hammer velocity corresponding to the performer's will can be inputted through the keyboard.

TONE SYNTHESIZING PORTION

Figure 6:
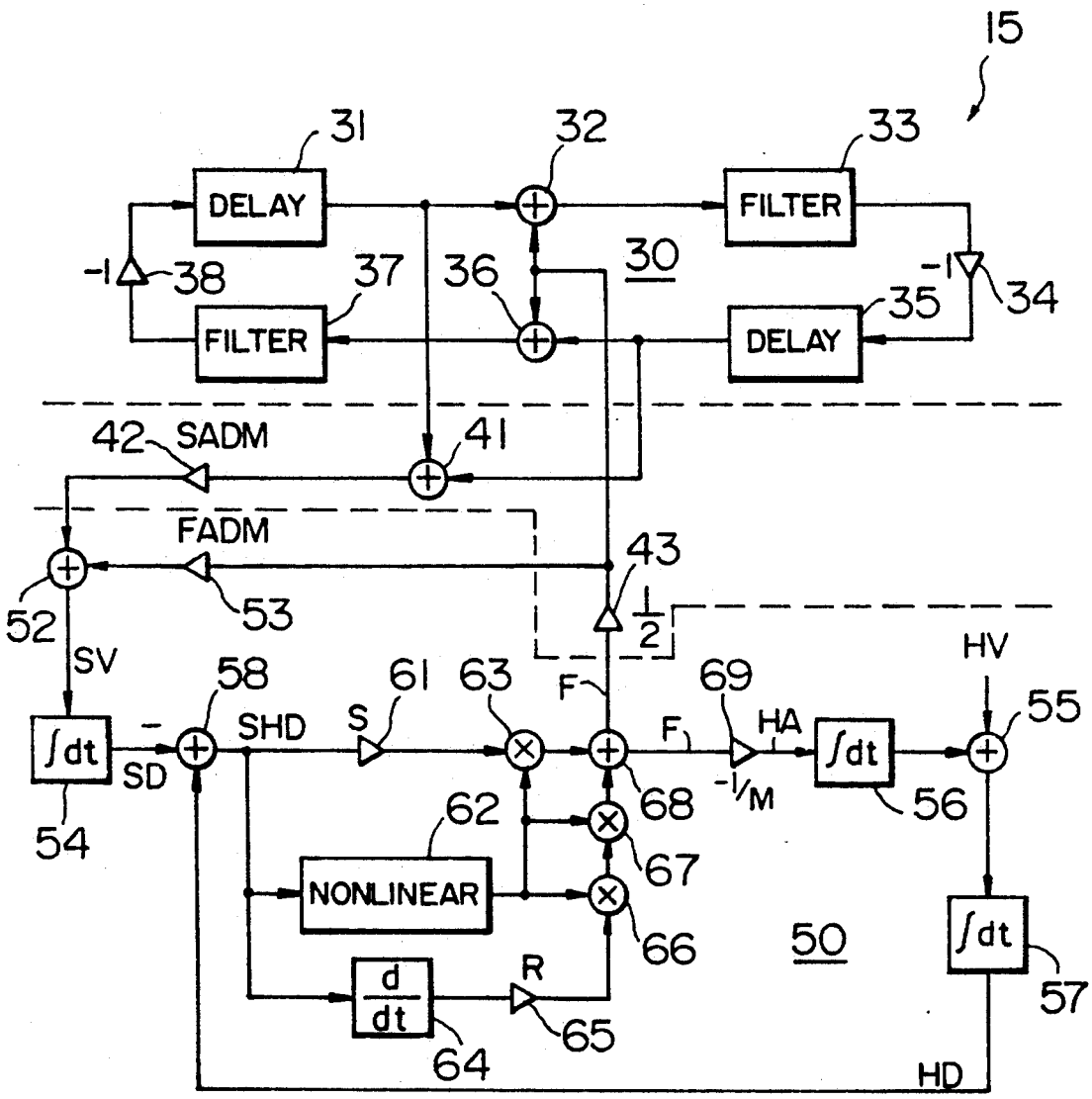
FIG. 6 is a block diagram showing an example of the structure of a tone synthesizing portion 15 in this embodiment of the invention.

FIG. 6 is a block diagram showing a first example of the structure of the tone synthesizing portion 15. The tone synthesizing portion 15 has a loop circuit 30 for simulating the behavior of a string in the piano, an excitation circuit 50 for simulating the behavior of a hammer, a multiplier 43 for mediating a signal fed from the excitation circuit 50 to the loop circuit 30, and an adder 41 and a multiplier 42 for mediating a signal fed from the loop circuit 30 back to the excitation circuit 50.

The loop circuit 30 includes a delay circuit 31, an adder 32, a filter 33, a phase inversion circuit 34, a delay circuit 35, an adder 36, a filter 37 and a phase inversion circuit 38 connected as a closed loop and simulates a string of the piano. An input signal to the loop circuit is given to the adders 32 and 36, so that output signals from the delay circuit 31 and 35 are taken out and added by the adder 41. The addition result is fed back to the excitation circuit 50 through the multiplier 42. The signal input point in the loop circuit 30 corresponds to a string-striking point P at which the hammer HM strikes on the string STR in FIG. 12. That is, the delay time in the course from the input of the adder 36 to the output of the delay circuit 31 in the loop circuit 30 is equal to the delay time required for a round trip of vibration on a line segment (length L1) between the string-striking point P for the string STR and a fixed terminal T1, and the delay time in the course from the input of the adder 32 to the output of the delay circuit 35 in the loop circuit 30 is equal to the delay time required for a round trip of vibration on a line segment (length L2) between the string-striking point P and another fixed terminal T2. The phase inversion circuits 38 and 34 are provided to simulate the phenomenon that the phase of vibration wave is inverted at the fixed terminals T1 and T2. The filters 37 and 33 are provided to simulate decay in the case where vibration propagates on the string STR, acoustic loss in the case where the vibration of the string STR is radiated directly to the air, acoustic loss in the case where the vibration of the string STR propagates to a piano sound-board (or the like) through the fixed terminals T1 and T2, and the like. Because it is general that this type acoustic loss increases as the frequency becomes higher, the filters 37 and 33 are constituted by low-pass filters. The excitation circuit 50 will be described hereunder. The hammer velocity signal HV outputted from the A/D converter 14 (see FIG. 1) is given to one input terminal of an adder 55. The integration value outputted from the integrator 56 is given to the other input terminal of the adder 55. The integration value is equivalent to the change of velocity which is produced in the hammer HM by interaction between the hammer HM and the string STR. The arithmetic operation for calculating the change of velocity will be described in detail later. A signal formed by correcting the hammer velocity signal HV by reference to the change of velocity, that is, a signal corresponding to the velocity of the hammer HM at the present point of time, is obtained. The output signal from the adder 55 is integrated by the integrator 57, so that a hammer displacement signal HD corresponding to the displacement of the hammer HM is generated.

An adder 52 receives both output signals from multipliers 42 and 53. The output signal from the multiplier 42 corresponds to the velocity of the string STR at the string-striking point P in FIG. 12, and the output signal from the multiplier 53 corresponds to the velocity correction given to the string STR by the hammer HM. Accordingly, a signal SV corresponding to the velocity of the string STR at the present point of time is outputted from the adder 52. Then, the signal SV is integrated by the integrator 54, so that a string displacement signal SD corresponding to the displacement of the string STR is obtained. The string displacement signal SD is subtracted from the hammer displacement signal HD by a subtracter 58, so that a relative displacement signal SHD corresponding to the quantity of thrust of the string STR with respect to the hammer HM is obtained.

Figure 7:
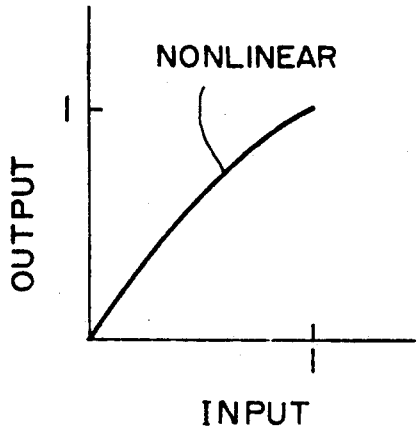
FIG. 7 is a graph showing an example of nonlinear transformation achieved by the tone synthesizing portion 15.

The relative displace signal SHD is fed to a multiplier 61, a nonlinear circuit 62 and a differentiator 64. For example, the nonlinear circuit 62 is constituted by an ROM and has nonlinear input/output response characteristic as shown in FIG. 7. As shown in FIG. 7, the output from the nonlinear circuit 62 increases as the input signal value increases. The gradient of the output decreases as the input signal value increases. The multiplier 61 multiplies the relative displacement signal SHD by a multiplication coefficient S corresponding to the elasticity of the hammer HM. A multiplier 63 multiplies the output from the multiplier 61 by the output signal from the nonlinear circuit 62. As a result, a signal corresponding to the repulsive force produced between the hammer HM and the string STR on the basis of the elastic characteristic of the hammer HM is outputted from the multiplier 63. The output from the multiplier 63 increases as the relative displacement signal SHD increases. When the relative displacement signal SHD increases to a predetermined value, however, the output from the nonlinear circuit 62 is saturated. Accordingly, the output from the multiplier 63 is also saturated. As described above, an operation faithful to the behavior based on the elasticity of the hammer HM is obtained.

Figure 8:
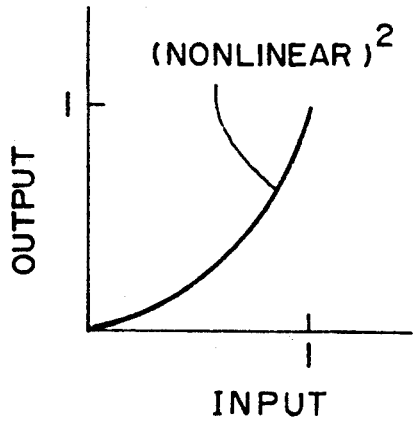
FIG. 8 is a graph showing another example of nonlinear transformation achieved by the tone synthesizing portion 15.

On the other hand, a multiplier 65 multiplies the signal obtained by differentiating the relative displacement signal SHD through the differentiator 64, by a multiplication coefficient R corresponding to the viscosity of the hammer HM. Multipliers 66 and 67 twice multiply the output signal from the multiplier 65 by the output from the nonlinear circuit 62. By the twice multiplying operation, a signal formed by applying nonlinear transformation as shown in FIG. 8 to the relative displacement signal SHD is effectively multiplied by the output signal from the multiplier 65. As a result, a signal corresponding to the repulsive force produced between the hammer HM and the string STR on the basis of the viscosity of the hammer HM is outputted from the multiplier 65. The signal value of the output signal from the multiplier 65 increases as the change with the passage of time, of the relative displacement signal SHD increases. Even in the case where the change rate with the passage of time, of the relative displacement signal SHD is constant, the value of the output signal from the multiplier 67 increases as the value of the relative displacement signal SHD increases, that is, as the string STR thrusts the hammer HM more deeply. As described above, an operation faithful to the behavior based on the viscosity of the hammer HM is obtained. The output signals from the multipliers 63 and 67 are added by an adder 68, so that a signal F corresponding to the repulsive force between the hammer HM and the string STR is outputted from the adder 68.

Figure 12:
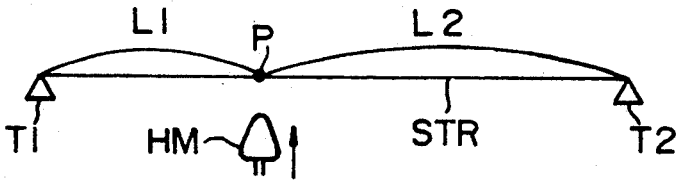
FIG. 12 is a diagram showing piano string STR and hammer HM simulated by the tone synthesizing portion 15.

The output signal F from the adder 68 is delivered to the multiplier 43 and multiplied by a multiplication coefficient ½. As a result, a velocity component of vibration wave propagating to opposite sides with respect to the string-striking point P of the string STR as shown in FIG. 12 is outputted from the multiplier 43. The output signal from the multiplier 43 is fed back to the adders 32 and 36 of the loop circuit 30. On the other hand, the output signal from the multiplier 43 is multiplied by a predetermined multiplication coefficient FADM in the multiplier 53, so that a signal corresponding to the change of velocity given to the string STR by the hammer HM is outputted from the multiplier 53.

Further, the output signal F from the adder 68 is multiplied by a multiplication coefficient $-1/M$ (in which M represents the mass of the hammer HM) in the multiplier 69, so that a signal HA corresponding to acceleration acting on the hammer HM is outputted from the multiplier 69. The signal HA is integrated by the integrator 56, so that a signal corresponding to the change of velocity of the hammer HM is obtained.

The operation of the tone synthesizing portion 15 will be described hereunder. When a key KEYj corresponding to the tone synthesizing portion 15 is depressed and a key switch signal KON/KOFF corresponding to the key is started, initial values 0 are respectively preset to the integrators 56 and 57 to start simulation from the condition that the hammer HM strikes against the string STR. A hammer velocity signal HV corresponding to the key depressing operation is outputted from the A/D converter 14. The hammer velocity signal HV is fed to the integrator 57 through the adder 55 and integrated by the integrator 57, so that a hammer displacement signal HD is outputted from the integrator 57. The hammer displacement signal HD is fed to the subtracter 58, so that a relative displacement signal SHD is outputted from the subtracter 58. Then, a signal F corresponding to the relative displacement signal SHD is produced in the same manner as described above. A signal HA corresponding to acceleration of the hammer HM and a signal corresponding to the change of velocity of the hammer HM are successively calculated on the basis the signal F, so that the signal (the output from the adder 55) corresponding to the velocity of the hammer at the present point of time is corrected.

On the other hand, the signal F is fed back to the loop circuit 30 through the multiplier 43 and, at the same time, the signal F is also fed to the integrator 54 through the multiplier 53 and the adder 52 and integrated by the integrator 54. As a result, the integration value of the integrator 54, that is, the signal corresponding to the displacement of the string STR, is corrected. The signal delivered from the excitation circuit 50 to the adder 36 in the loop circuit 30 is taken out of the loop circuit 30 again through the filter 37, phase inversion circuit 38 and delay circuit 31. On the other hand, the signal delivered to the adder 32 is taken out of the loop circuit 30 again through the filter 33, phase inversion circuit 34 and delay circuit 35. The signals taken out of the loop circuit 30 are added by the adder 41, so that the addition result is fed back to the excitation circuit 50 through the multiplier 42. As a result, not only the signal SV corresponding to the velocity of the string STR is corrected but the signal SD corresponding to the displacement of the string STR is corrected. Thereafter, both simulation of interaction between the hammer HM and the string STR and simulation of the propagation of vibration in the string STR are performed by the excitation circuit 50 and the loop circuit 30 in the same manner as described above. Then, a signal corresponding to the vibration velocity component of the string STR is picked out from an arbitrary node in the loop circuit 30, so that the signal is outputted as a tone signal.

Figure 9:
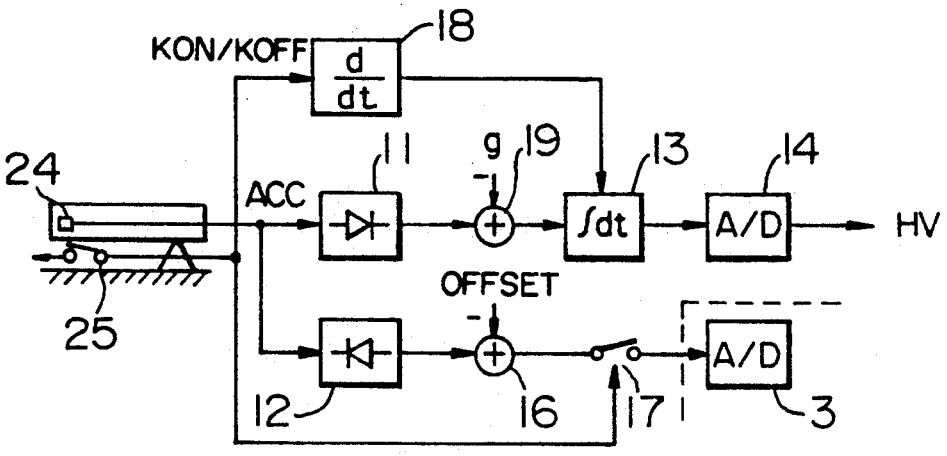
FIG. 9 is a block diagram showing another example of the structure of the portion related to the detection of key depression in this embodiment of the invention.

Although description has been made upon the case where simulation is started from the point of time when the hammer HM strikes against the string STR, the actual tone generated by the piano can be regenerated more faithfully in the case where the simulation includes simulation of the condition that the movement of the hammer HM (which is far from the string STR at an initial state) toward the string STR is started in response to the depression of the key. In this case, the structure of the electronic musical instrument is changed so that an initial displacement value expressing the distance between the hammer HM and the string STR is preset to the integrator 57 of the tone synthesizing portion 15 (FIG. 6) at the time of the starting of the key switch signal KON/KOFF. Further, with this change, the structure of the circuit related to the detection of key depression as shown in FIG. 3 is changed to the structure as shown in FIG. 9. That is, a subtracter 19 for subtracting a signal g corresponding to gravity acceleration from the output of the halfwave rectification circuit 11 to supply the subtraction result to the integrator 13 is added to the structure of FIG. 3. By this method, the condition that the hammer HM returns without reaching the string STR when touch is considerably faint can be simulated. Further, the condition that the hammer HM faintly strikes against the string STR in the case of pianissimo can be reproduced.

ANOTHER EXAMPLE OF THE STRUCTURE OF THE TONE SYNTHESIZING PORTION

Figure 10:
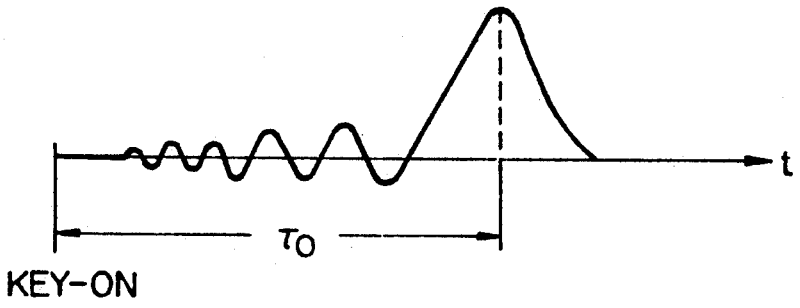
FIG. 10 is a waveform graph showing a vibration waveform as appears in a string of piano.

The filters 33 and 37 in the tone synthesizing portion shown in FIG. 6 can be constituted by finite impulse response (FIR) filters, infinite impulse response (IIR) filters, all-pass filters or the like. In the case where lower-dimensional filters are used as the filters 33 and 37, however, the degree of freedom in the time direction becomes small. Accordingly, in this case, the frequency of vibration reciprocatingly propagating on the string STR is adjusted by the delay time of the delay circuits 31 and 35. The behavior of the vibrating string STR can be approximated to some degree on the frequency axis, but the phase characteristic of the vibration on the string STR can be little approximated. On the other hand, the string STR of the actual piano has elasticity, so that there occurs such diffusion that vibration propagates more speedily as the frequency thereof becomes higher. FIG. 10 shows an example of the impulse response of the string. As shown in FIG. 10, leader wave of a high frequency appears in the actual piano in a period $\tau 0$ from the point of time when the string is struck to the point of time when main pulses appear in the string. Therefore, the vibration of the string exhibits inharmonic characteristic which is a factor for generating a touch of the piano.

From the viewpoint of the interaction between the hammer HM and the string STR, it is necessary to reproduce force given to the hammer HM by wave reflected at the respective fixed terminals T1 and T2 and fed back to the string-striking point P in a period in which the hammer HM touches the string STR. Because the hammer HM has both viscosity and elasticity, the hammer HM and the string STR move while touching each other during a very short period. If the force given to the hammer HM by the leader wave from the string STR can be simulated faithfully in this period, the interaction between the hammer HM and the string STR can be described so exactly that a real piano tone can be provided.

Various models of the tone synthesizing portion by which a musical tone faithful to the real piano tone can be synthesized will be described hereunder upon the consideration of the aforementioned problem. Model I in which impulse response including the phase characteristic of the string STR is accurately approximated by a multi-dimensional FIR filter will be described first. Model II in which the phase characteristic of the string is approximated by an all-pass filter will be described next. Model III in which the model I having a disadvantage in shortening decay because of error produced at the time of calculation of the coefficient of the FIR filter is improved by combining the models I and II will be described next. In addition, model IV in which an inharmonic tone of high frequency caused to generate by a longitudinal vibration in a piano string can be synthesized as an example of improvement of the tone synthesizing portion, model V in which the generation of tones based on a plurality of strings is simulated, and model VI in which repeated tone generation can be made, will be described in order. Finally, model VII in which not only string striking based on the hammer but muting based on a damper are considered will be described.

MODEL I

Tone Synthesizing Portion using Multi-dimensional FIR Filters

Figure 11:
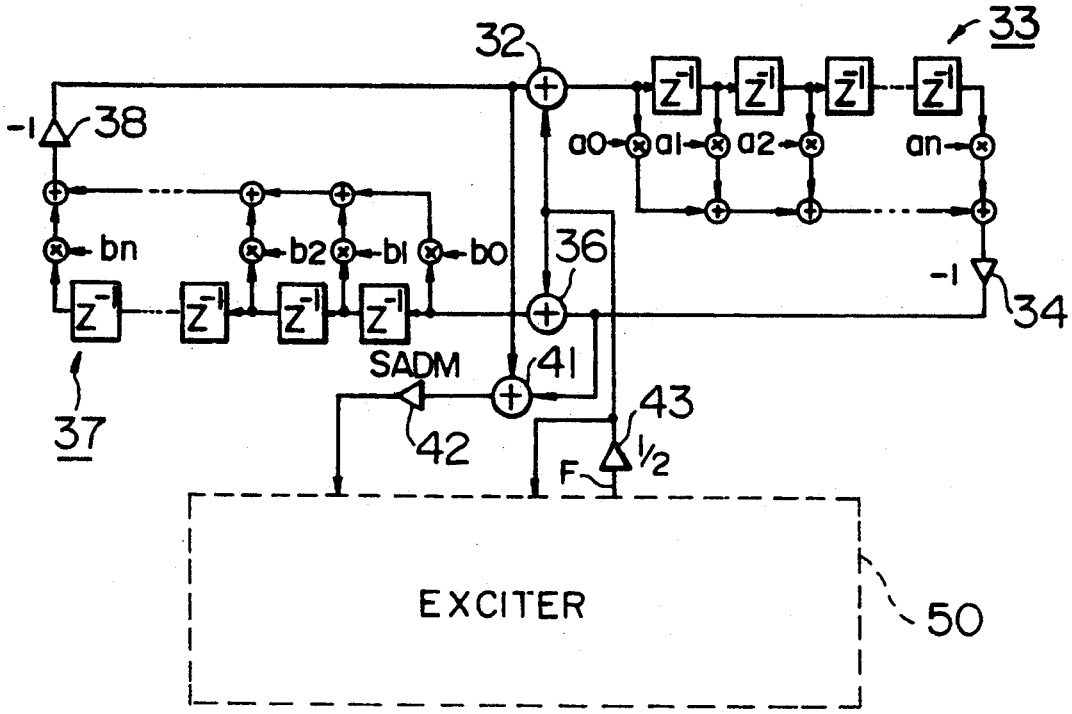
FIG. 11 is a block diagram showing the structure of model I as another example of the structure of the tone synthesizing portion 15.

FIG. 11 is a block diagram showing an example of the structure of the tone synthesizing portion based on this model I. The tone synthesizing portion uses multi-dimensional FIR filters as the filters 33 and 37 in FIG. 6. These FIR filters provide a transmission function of a piano string as represented by the expression (1):

$$F(\omega)=\mathrm{Exp}\{-(a+b^2\omega^2)\}\mathrm{Exp}\{-j\omega\tau_0(1-\gamma\tau_0^2\omega^2)\} \quad (1)$$

in which: $\tau_0$ represents the delay time from the point of time when the string STR is struck to the point of time when main pulses appear in the string STR; $\gamma$ represents a coefficient related to the inharmonic characteristic of the vibration of the string STR; a represents a coefficient corresponding to air friction acting on the string STR; and b represents a coefficient corresponding to the radiating characteristic of the vibration of the string STR in the case where the vibration is radiated to the air. The transmission function has been described in the readings: by Nakamura, "Piano Tone Synthesis Using Digital Filters By Computer Simulation", the University of Electro-Communications; and by Nakamura, "Application of Digital Filters to Vibration of Piano Strings having Interaction", the proceeding of March, 1987, Meeting of Acoustical Society of Japan. The impulse response of the piano string is calculated by applying inverted Fourier transform to the transmission function represented by the expression (1). Multiplication coefficients $a_0$ to $a_n$ and $b_0$ to $b_n$ of the respective FIR filters are obtained by sampling the impulse response. The transmission function of the string is mainly determined by the pitch and inharmonic characteristic thereof, by which the number of FIR filter stages and the coefficients of the FIR filters are determined.

The signal F (corresponding to the force when the hammer HM strikes against the string STR) from the excitation circuit 50 has high frequency components because the starting of the signal F is sharp. In the structure of FIG. 11, the signal containing large quantity of high frequency components passes through the multi-dimensional FIR filters 33 and 37, so that a considerable quantity of leader wave appears in the signal waveform circulating in the loop circuit 30. The leader wave is taken out of the loop circuit 30 and fed back to the excitation circuit 50. As a result, the tone signal waveform picked up from the tone synthesizing portion has a strong resemblance to the real piano tone.

In the case where the processing in the tone synthesizing portion having the structure of FIG. 11 is made by software, a considerable quantity of arithmetic operation is required if all the delay times in the loop circuit 30 are provided by FIR filter operation. When the impulse response decays considerably, the FIR filter arithmetic operation may be replaced by multi-stageous delay operation to decrease the quantity of arithmetic operation. The degree of freedom in tone color can be improved by combining delay and lower-dimensional filters and the like. Examples of the lower-dimensional filter used herein are FIR low-pass filter, FIR high-pass filter, IIR low-pass filter, all-pass filter and the like.

MODEL II

Tone Synthesizing Portion using All-Pass Filters

Figure 13:
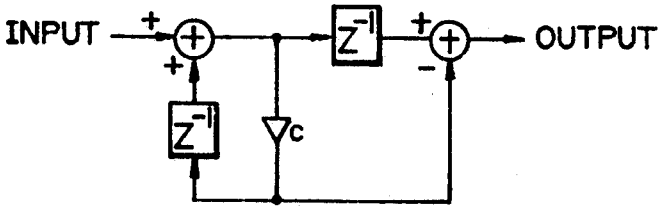
FIG. 13 is a block diagram showing an example of the structure of the one-dimensional all-pass filter.
Figure 14:
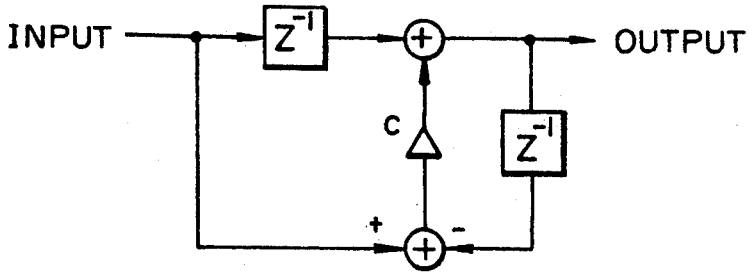
FIG. 14 is a block diagram showing another example of the structure of the one-dimensional all-pass filter.
Figure 15:
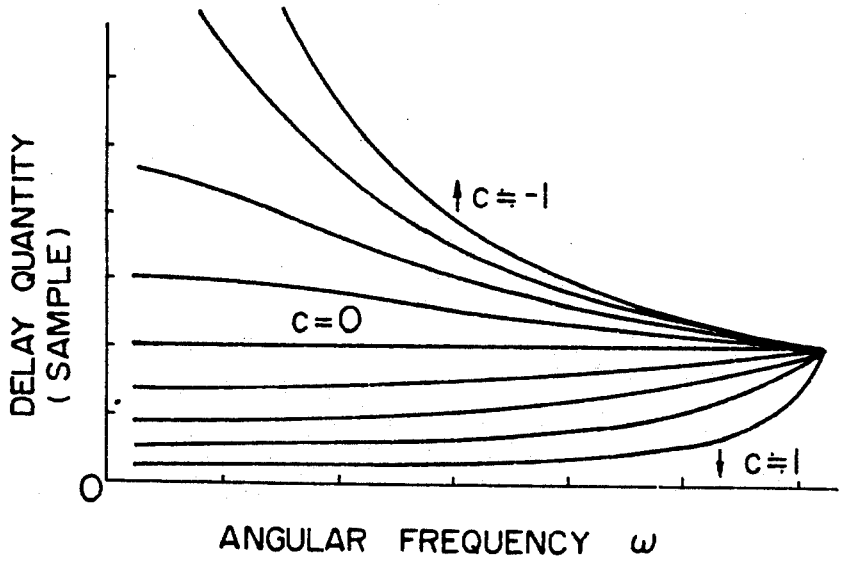
FIG. 15 is a graph showing an example of the phase characteristic of the one-dimensional all-pass filter.

Examples of the general one-dimensional all-pass filter will be described before description of this model II. FIGS. 13 and 14 show examples of the structure of the one-dimensional all-pass filter. The terminology "all-pass filter" used herein means a filter in which the gain is constantly 1 as an exact value regardless of the frequency of the input signal and in which the phase delay depends on the frequency. The phase delay quantity of the all-pass filter is determined by the multiplication coefficient C of the multiplier in the filter. An example of the transmission function of the one-dimensional all-pass filter is shown in the expression (2). The phase characteristic formula based on the transmission function represented by the expression (2) is shown in the expression (3). The frequency characteristic of the delay quantity (phase delay) in the case where the coefficient C in the phase characteristic formula represented by the expression (3) is changed in a range of $-1$ to 1 $[-1<C<1]$ is shown in FIG. 15.

$$H(z)=(C+z^{-1})/(1+Cz^{-1}) \quad (2)$$

$$P(\omega)=H(e^{j\omega t})/\omega T \quad (3).$$

Figure 16:
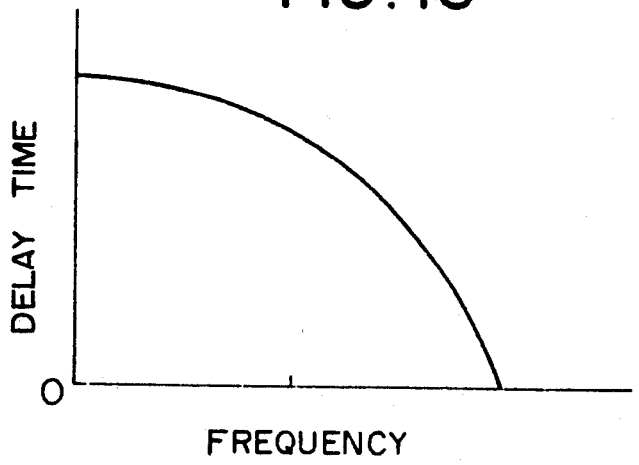
FIG. 16 is a graph showing an example of the phase characteristic in a piano string.

In the expression (3), T represents the delay time of one-sample delay circuit. As shown in FIG. 15, the delay quantity in low frequency increases rapidly as C approaches $-1$. The quantity of delay time in high frequency is however near one-sample period. FIG. 16 is a graph formed by plotting the phase characteristic of the real piano string. As shown in FIG. 16, in the case of the piano string, the delay quantity decreases as the frequency of the vibration increases. Accordingly, the vibration propagates on the string more rapidly as the frequency thereof increases. Accordingly, if the loop circuit 30 is formed by connecting all-pass filters multistageously to attain the phase delay based on the delay quantity (the number of samples) corresponding to the fundamental pitch of the musical tone, the phase characteristic of the piano string can be simulated.

The delay quantity corresponding to the fundamental pitch is generally of the order of hundreds of samples, because the delay quantity is obtained by dividing the period of the waveform of the tone having the target pitch by the sampling period. The delay quantity of a one-dimensional all-pass filter is, however, of the order of several samples. Therefore, a method in which phase delay is given to frequency components of not higher than a predetermined value (of the order of hundreds of kHz) by all-pass filters of the order of tens of stages and in which phase delay is given to the other frequency components by delay circuits, is considered now.

Figure 17:
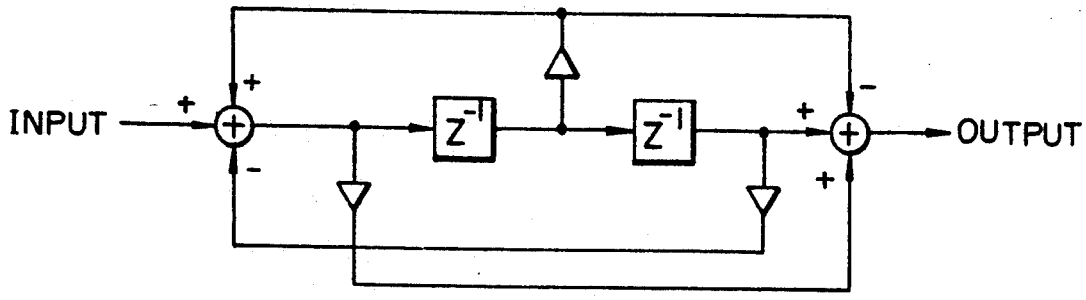
FIG. 17 is a block diagram showing an example of the structure of the two-dimensional all-pass filter.
Figure 18:
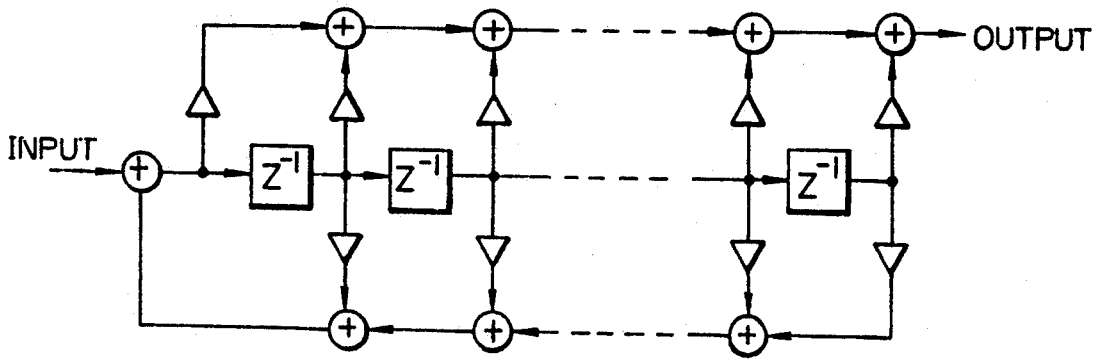
FIG. 18 is a block diagram showing an example of the structure of the multi-dimensional all-pass filter.
Figure 19:
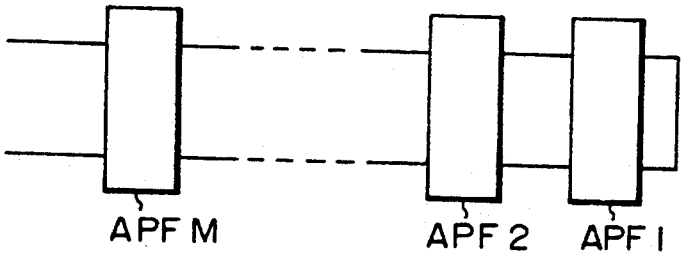
FIG. 19 is a block diagram showing an example of the structure of the lattice-type all-pass filter.
Figure 20:
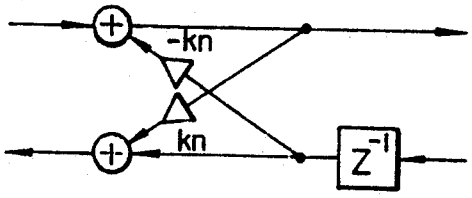
FIG. 20 is a block diagram showing the structure of the n-th order element of the all-pass filter depicted in FIG. 19.

As another method, the one-dimensional all-pass filter may be replaced by a multi-dimensional all-pass filter. FIG. 17 shows an example of the structure of a two-dimensional all-pass filter, and FIG. 18 shows the structure of a multi-dimensional all-pass filter as a generalized example. FIG. 19 shows the structure of a lattice-type all-pass filter, and FIG. 20 shows the structure of the m-th order element thereof. Other examples of the structure of one- and two-dimensional all-pass filters have been described in the reading, "Foundation of Digital Signal Processing" (supervised by Shigeo Tsujii: Institute of Electronics, Information and Communication Engineers of Japan), and the like. Because the peak frequency of the delay quantity and the sharpness thereof can be set to the multi-dimensional all-pass filter, the string-striking operation of the piano can be simulated considerably accurately by combining multi-dimensional all-pass filters and one-dimensional all-pass filters.

An example of the structure of the tone synthesizing portion using this model II will be described hereunder. This model II is formed by replacing the multi-dimensional FIR filters 33 and 37 in the structure of FIG. 11 by devices formed by connecting a multistageous all-pass filter and a delay circuit in series. The signal F (corresponding to the force given to the string STR by the hammer HM) from the excitation circuit 50 is sharp in the starting thereof and has high frequency components. Difference is produced between phase delays of frequency components by passing the signal F through the all-pass filter, so that higher frequency components circulate in the loop circuit 30 more speedily compared with lower frequency components. Accordingly, in the tone waveform picked up after a round trip on the loop circuit 30, a considerable quantity of leader wave appears prior to main pulses. Accordingly, fine wrinkles (high frequency components) are produced in the signal waveform circulating in the loop circuit 30 and fed back to the excitation circuit 50. As a result, the operation of feeding the force due to a specific frequency component from the string STR back to the hammer HM is simulated. As a result of the operation, a musical tone more faithful to the real piano tone is synthesized.

MODEL III

Tone Synthesizing Portion improved in Decay

Figure 21:
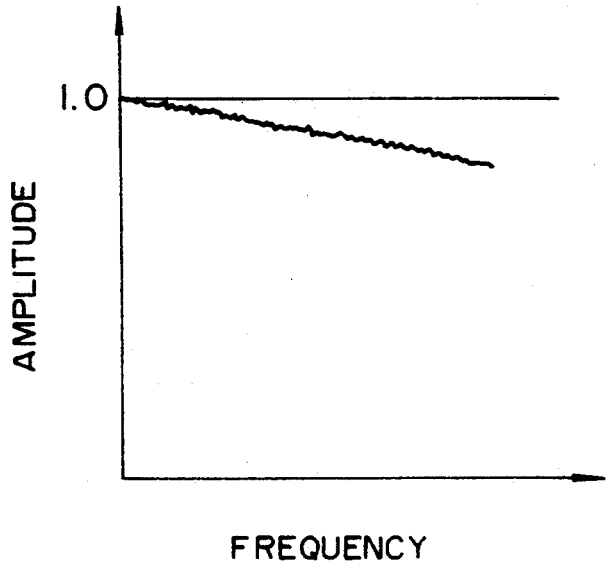
FIG. 21 is a graph showing an example of the amplitude response in the case where a higher-dimensional FIR filter is interposed in the loop circuit 30 of the tone synthesizing portion 15.
Figure 22:
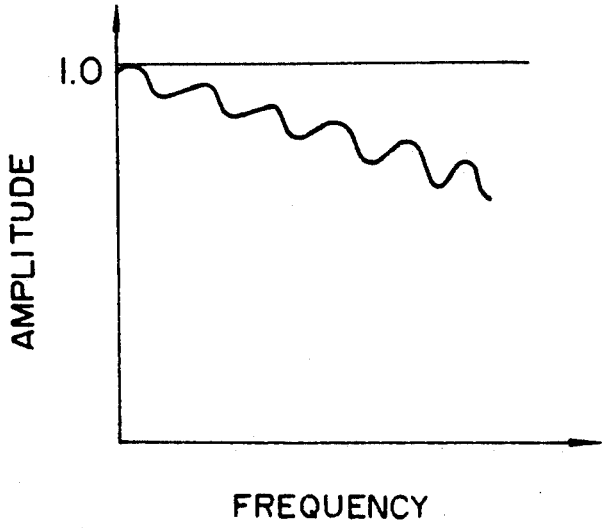
FIG. 22 is a graph showing an example of the amplitude response in the case where a lower-dimensional FIR filter is interposed in the loop circuit 30 of the tone synthesizing portion 15.

In the case where the transmission characteristic of the string STR is provided by FIR filters as described above in the model I, it is preferable that these filters are constituted by all-pass filters. Further, it is ideal that the operation corresponding to the decay of the vibration of the string STR in the tone synthesizing portion is provided by setting the multiplication coefficients of the phase inversion circuits 34 and 38 corresponding to the bridge to a slightly larger value than $-1$. The respective multiplication coefficients of the FIR filters calculated on the basis of the impulse response of the string STR, however, contain error. Accordingly, it is difficult to attain all-pass characteristic, so that error arises in the amplitude response correspondingly to the frequency. In this case, the model I matched with a high pitch area is low in the number of dimensions in the FIR filters, so that error in the amplitude response becomes large as shown in FIG. 22 and varies widely in a large period. On the contrary, the model I matched with a low pitch area is high in the number of dimensions in the FIR filters, so that the period of error in the amplitude response becomes small as shown in FIG. 21. In the model I (the structure of FIG. 11) simulating the operation of separate portions formed by dividing the string into two with respect to the string-striking point, the impulse response of one string is provided by two FIR filters. Accordingly, the number of dimensions per one FIR filter is lowered, so that error in the amplitude response becomes large. Accordingly, in the frequency in which the amplitude response is considerably smaller than 1, the delay becomes short, so that the envelope of harmonic components becomes different from that in the real piano tone.

Means for solving this problem will be described hereunder. The reason why the model I performs simulation after dividing the string STR into two is in that the interaction between the hammer HM and the string STR is simulated accurately in a period in which the hammer HM and the string STR collide with each other. Accordingly, if the interaction between the hammer HM and the string STR is terminated by moving the hammer HM away from the string STR, the division of the string STR into two is not required and the behavior of one string can be simulated by a filter. The structure of the model I may be modified on the basis of this thought so that a portion for simulating the interaction between the string STR and the hammer HM and a portion for simulating the propagation of vibration in the string STR are provided separately as follows.

Figure 23:
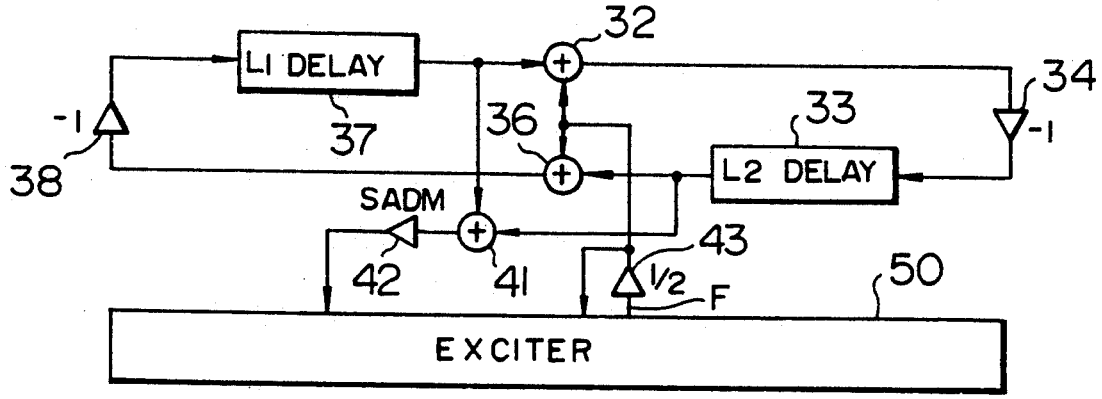
FIG. 23 is a block diagram showing a modified example of the tone synthesizing portion 15.

FIG. 23 is a block diagram showing a structure equivalent to the model I (FIG. 11). The same operation is made in FIGS. 11 and 23 except that the structure of FIG. 23 is reverse to the structure of FIG. 11 in the positional relation between the FIR filter 37 corresponding to the portion of length L1 of the string STR and the phase inversion circuit 38 and the positional relation between the FIR filter 33 corresponding to the portion of length L2 of the string STR and the phase inversion circuit 34.

Figure 24:
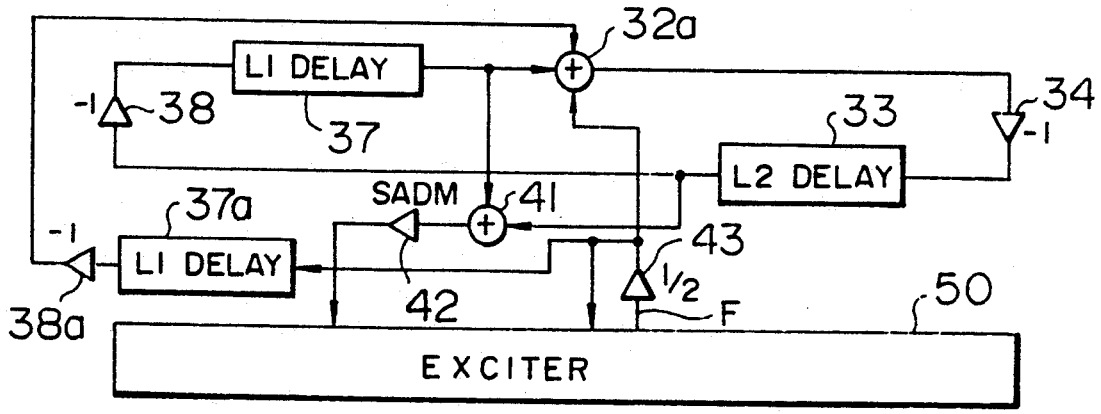
FIG. 24 is a block diagram showing another modified example of the tone synthesizing portion 15.

In the structure shown in FIG. 23, the adder 32 is replaced by a three-input adder 32*a* to thereby remove the adder 66. Further, a series circuit composed of an FIR filter 37*a* having the same structure as that of the FIR filter 37, and a phase inversion circuit 38*a* having the same structure as that of the phase inversion circuit 38, is additionally provided so that the output from the multiplier 43 is given to the FIR filter 37*a*. Further, the output from the multiplier 43, the output from the FIR filter 37 and the output from the phase inversion circuit 38*a* are added by the adder 32*a*, so that the addition result is supplied to the phase inversion circuit 34. By this modification, a structure shown in FIG. 24 is provided. In FIG. 23 or in FIG. 24, a signal obtained by adding the output signal from the multiplier 43 to a signal obtained by passing the output signal through the FIR filter corresponding to the length L1 and the phase inversion circuit is delivered to the phase inversion circuit 34. Accordingly, in the structure of FIG. 24, an operation quite equivalent to the operation obtained in the structure of FIG. 23 is obtained.

Figure 25:
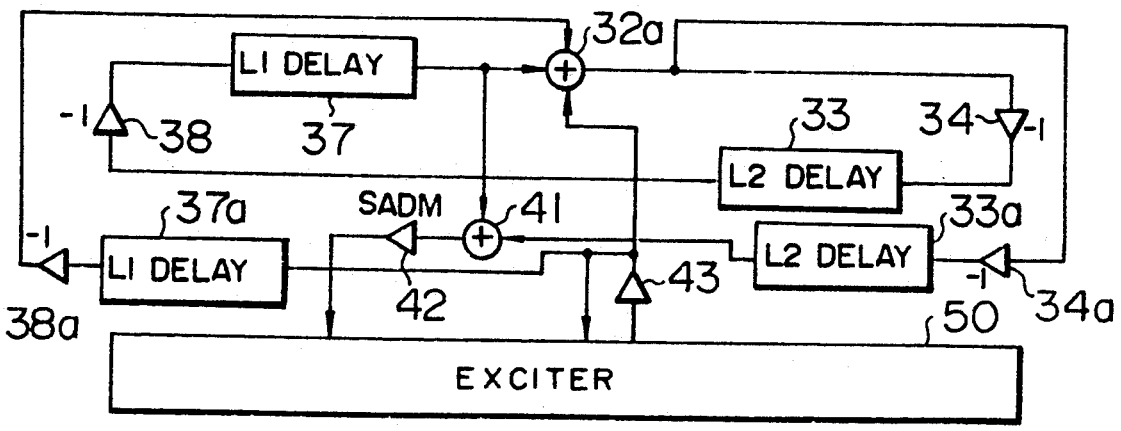
FIG. 25 is a block diagram showing a further modified example of the tone synthesizing portion 15.

The structure of FIG. 24 may be modified so that not only the supply of the output from the FIR filter 33 to the adder 41 is removed but a series circuit composed of a phase inversion circuit 34*a* having the same structure as that of the phase inversion circuit 34 and an FIR filter 33*a* having the same structure as that of the FIR filter 33 is connected to the output terminal of the adder 32*a* to supply the output from the FIR filter 33*a* to the adder 41. By this modification, a structure shown in FIG. 25 is obtained. In FIG. 24 or in FIG. 25, a signal obtained by adding the output signal from the FIR filter 37 to a signal obtained by passing the output signal of the adder 32*a* through the phase inversion circuit and the FIR filter corresponding to the length L2 is fed back to the excitation circuit 50 through the multiplier 42. Accordingly, in the structure of FIG. 25, an operation quite equivalent to the operation in the respective structures of FIGS. 24 and 23 is obtained.

As described above, all elements related to the interaction between the string STR and the hammer HM can be collected to the outside of the loop, so that a multi-dimensional FIR filter corresponding to one string STR can be provided in the loop, finally. As a result, reduction of error in the amplitude response can be attained.

Figure 26:
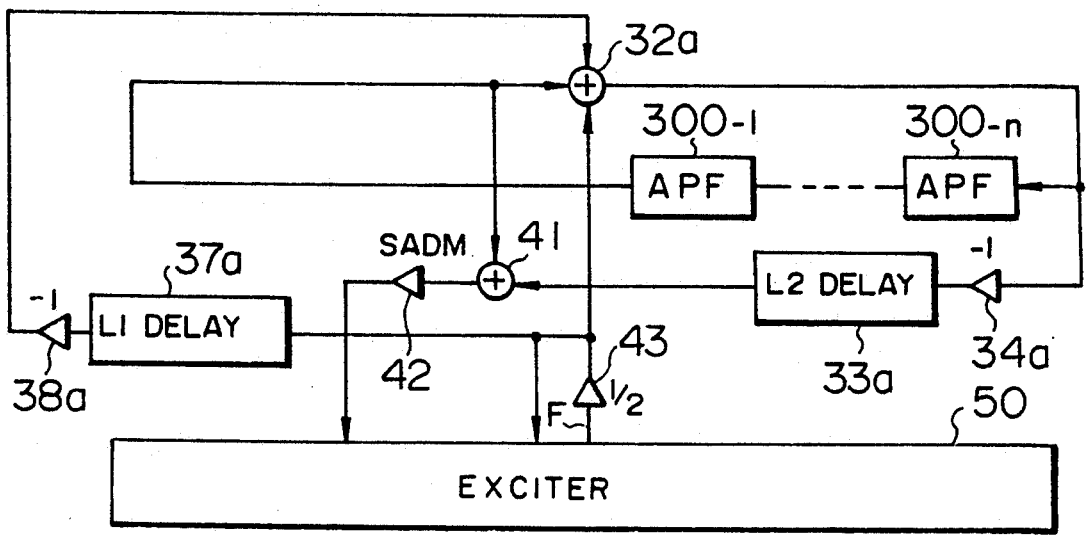
FIG. 26 is a block diagram showing the structure of model III as another example of the structure of the tone synthesizing portion 15.

Model III having a structure shown in FIG. 26 is formed by replacing the FIR filters 33 and 37 in the structure of FIG. 25 by multi-stageous all-pass filters 300-1 to 300-n. In this model III, not only the interaction between the hammer HM and the string STR is simulated by the multi-dimensional FIR filters 37*a* and 33*a* but the behavior of the string STR is simulated by the all-pass filters 300-1 to 300-n. As described above, not only the all-pass filters are interposed in the loop circuit in which the amplitude characteristic is important, but the FIR filters are interposed in the portion related to the interaction between the hammer HM and the string STR in which the phase response is important. Accordingly, both the exact reproduction of the vibration waveform of the string STR and the exact reproduction of the interaction between the hammer HM and the string STR can be made.

MODEL IV

Tone Synthesizing Portion in which an Inharmonic Longitudinal Vibration Tone can be synthesized The vibration propagating on the string STR is classified into transverse vibration having the amplitude in a direction perpendicular to the string and longitudinal vibration having the amplitude in a direction (axial direction) parallel to the string. The longitudinal vibration is compression wave caused by the longitudinal expansion of the string STR when the hammer HM strikes against the string STR, so that the longitudinal vibration propagates at a higher speed than ten times as much as the speed of the transverse vibration. When the piano is really played strongly, a characteristic tone of the pitch higher than ten times as much as the fundamental tone can be heard. This is called "an inharmonic longitudinal vibration tone" caused by the longitudinal transverse of the string. The inharmonic longitudinal vibration tone cannot be heard when the touch is faint. The inharmonic longitudinal vibration tone becomes larger rapidly as the touch becomes stronger (The strength of the inharmonic longitudinal vibration tone is proportional to the square of the touch or to the square of the transverse amplitude).

Figure 27:
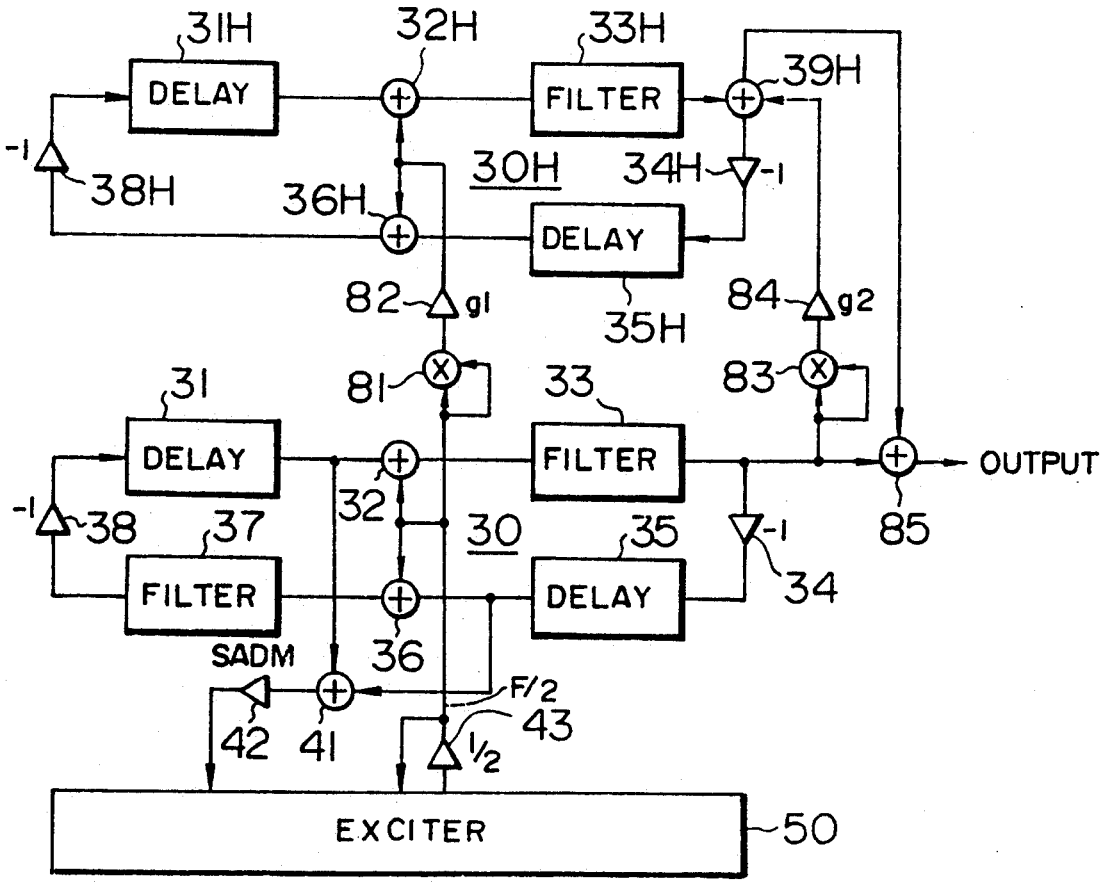
FIG. 27 is a block diagram showing the structure of model IV as a further example of the structure of the tone synthesizing portion 15.

In any of the models having been described, only transverse vibration is simulated. On the contrary, in this model IV, not only transverse vibration but longitudinal vibration can be simulated to thereby synthesize a musical tone including an inharmonic longitudinal vibration tone as closely resembles the real piano tone. It is however impractical that the inharmonic longitudinal vibration tone is synthesized strictly, because the quantity of arithmetic operation is increased enormously. Therefore, in this model IV, as shown in FIG. 27, a loop circuit 30H for synthesizing a inharmonic longitudinal vibration tone is added to the structure of FIG. 6, so that the loop circuit 30H is provided separately from the loop circuit 30 corresponding to the real string STR. The loop circuit 30H for synthesizing an inharmonic longitudinal vibration tone is formed by connecting a delay circuit 31H, an adder 32H, a filter 33H, an adder 39H, a phase inversion circuit 34H, a delay circuit 35H, an adder 36H and a phase inversion circuit 38H like a loop. The delay circuits 31H and 35H are small in the number of delay stages compared with the delay circuits 31 and 35. The filter 33H is a lower-dimensional filter. The output signal F/2 (corresponding to the force given to the string STR by the hammer HM) from the multiplier 43 is injected in the loop circuit 30. On the other hand, the output signal F/2 from the multiplier 43 is squared by a multiplier 81. Then, a multiplier 82 multiplies the squared result by input gain g1. The multiplication result is injected into the loop circuit 30H through the adder 32H and 36H. A signal at the input terminal of the phase inversion circuit 34 corresponding to the bridge T2, that is, a signal corresponding to the transverse vibration of the string STR, is picked up. This signal is squared by a multiplier 83. A multiplier 874 multiplies the squared result by gain g2. The multiplication result is injected into the loop circuit 30H through the adder 39H. Then, a signal corresponding to the transverse vibration propagating in the loop circuit 30 and a signal corresponding to the longitudinal vibration (an inharmonic longitudinal vibration tone) propagating in the loop circuit 30H are respectively picked up and added by an adder 85, so that the resulting signal is outputted as a tone signal.

In the case where the electronic musical instrument is extended to be applied to a plurality of strings STR, a plurality of loop circuits for respectively synthesizing inharmonic longitudinal vibration tones may be provided correspondingly to the number of the strings.

MODEL V

Tone Synthesizing Portion in which Tone Generation by a Plurality of Strings is simulated The real piano has a plurality of strings corresponding to one pitch. These strings are generally delicately different in the characteristic thereof. Accordingly, it is preferable that circuits for respectively simulating the strings are provided in the tone synthesizing portion and that parameters of the circuits are respectively delicately shifted. By this method, a feeling of chorus and a feeling of undulation can be given to the resulting musical tone, so that the musical tone more closely resembles the real piano tone. Further, the circuits for simulating the respective strings can be arranged so that signal transfer between the circuits can be made, to thereby provide resonance between the plurality of strings.

Figure 28:
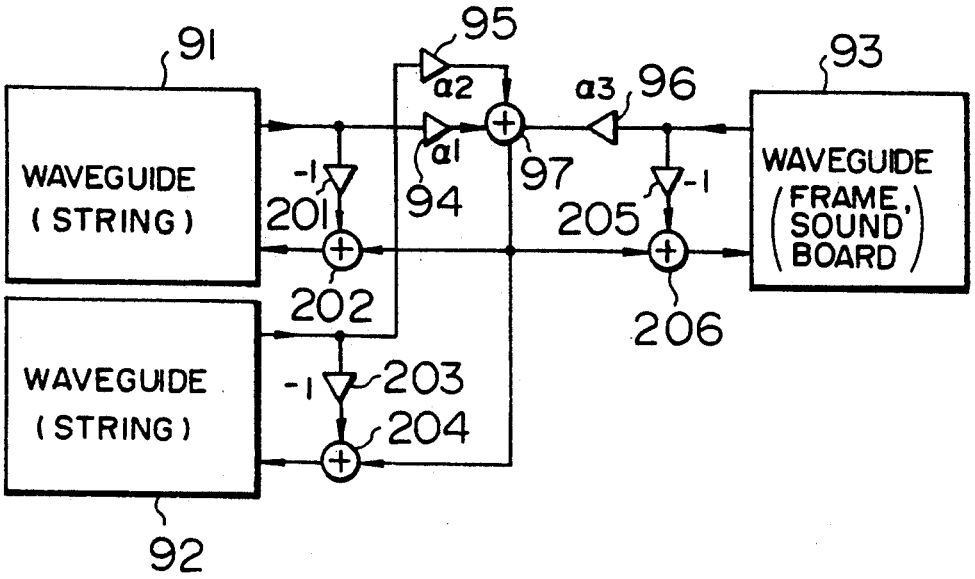
FIG. 28 is a block diagram showing the structure of model V as a further example of the structure of the tone synthesizing portion 15.

FIG. 28 shows an example of the structure of the tone synthesizing portion using this model V in which tone generation by a plurality of strings is simulated. In FIG. 28, the reference numerals 91 and 92 designate waveguides (duplex transmission circuits) for respectively simulating two strings, and 93 a waveguide for simulating a resonance system such as piano frame or soundboard. Here, the waveguides 91 and 92 are delicately different in the transmission characteristic thereof. The waveguide used herein has been described in U.S. Pat. No. 4,987,276.

In FIG. 28, output signals from the waveguides 91 to 93 are respectively multiplied by coefficients $\alpha_1$ to $\alpha_3$ in multipliers 94 to 96, so that the respective multiplication results are added by an adder 97. The coefficients $\alpha_1$, $\alpha_2$ and $\alpha_3$ have the following relations.

$$\alpha_1 + \alpha_2 + \alpha_3 = 2 \quad (4)$$

$$\alpha_1, \alpha_2 << \alpha_3$$

Then, the output signal from the adder 97 and a signal obtained by inverting the output signal from the waveguide 91 through a phase inversion circuit 201 are added by an adder 202. The addition result is fed back to the waveguide 91. The output signal from the adder 97 and a signal obtained by inverting the output signal from the waveguide 92 through a phase inversion circuit 203 are added by an adder 204. The addition result is fed back to the waveguide 92. The output signal from the adder 97 and a signal obtained by inverting the output signal from the waveguide 93 through a phase inversion circuit 205 are added by an adder 206. The addition result is fed back to the waveguide 93. In this structure, signal transfer between respective waveguides is made, so that two strings and resonance on the sound-board or the like can be simulated.

Although description has been made upon the case where this model is applied to two strings, it is a matter of course that this model can be applied to three or four strings. Further, this model may be extended to simulate all interactions between strings corresponding to 88 keys.

MODEL VI

Tone Synthesizing Portion adapted to Repeated Tone Generation

This model VI can be adapted to a repeated key depressing operation. This model VI is provided by adding tone generation control means to the structure of FIG. 6. That is, in this model VI, the integrator 57 for calculating the displacement of the hammer HM and the integrator 56 for calculating the velocity of the hammer HM are reset at the following points of time: a. when the end portion of the hammer HM is moved away from the string STR and returns to a position in a stationary state, b. when key release is detected, and c. when the next key depressing operation is made before the end portion of the hammer HM returns to a position in a stationary state.

Figure 29:
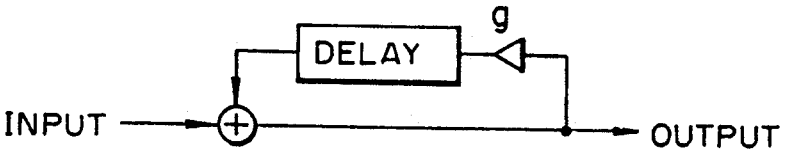
FIG. 29 is a block diagram showing the structure of a gain-control integrator used in model VI as a further example of the structure of the tone synthesizing portion 15.
Figure 30:
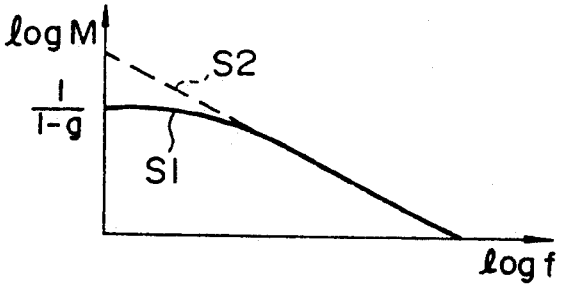
FIG. 30 is a graph showing an example of the frequency characteristic of the gain-control integrator depicted in FIG. 29.

At the respective points a to c of time, the hammer velocity signal HV is reset by resetting the integrator 13 in FIG. 1, so that the next depressing operation is waited for. The integrator 54 for calculating the displacement of the string STR may be reset at the respective points a to c of time. By giving up the resetting of the integrator 54 positively, the case where the hammer HM is brought into contact with the string STR by the next key depressing operation before the vibration of the string STR decays sufficiently can be simulated. In this case, errors and DC components in the input signal are accumulated in the integrator 54 and outputted from the integrator 54. Therefore, a gain-control integrator shown in FIG. 29 is used as the integrator 54. FIG. 30 shows the frequency characteristic S1 of the gain-control integrator and the frequency characteristic S2 of the general integrator. As shown in FIG. 30, the gain-control integrator is low in gain in a low frequency area compared with the general integrator. Accordingly, the aforementioned accumulation of errors or DC components can be reduced by using the gain-control integrator as the integrator 54. In this case, the gain g is selected suitably under the consideration of the lower-most pitch of the piano, the period in which the performer can depress the key repeatedly, or the like.

Figure 31:
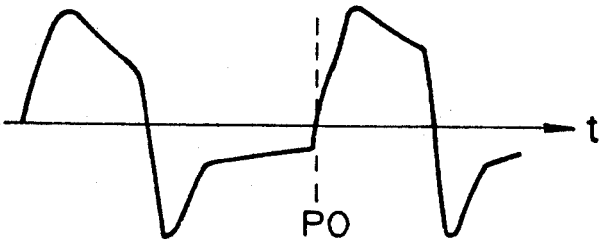
FIG. 31 is a waveform graph showing the operation of model VI.

Although description has been made upon the case where the respective integrators are initialized at the respective points a to c of time, the invention can be applied to the case where the respective integrators may be initialized on the basis of the judgment of the output level of the acceleration pickup 24 (FIG. 2). For example, the resetting operation may be made at the point of time when a zero cross point P0 (timing of turning a negative value over to a positive value) is detected in the output signal waveform of the acceleration pickup 24 correspondingly to the repeated key depressing operation as shown in FIG. 31.

MODEL VII

Tone Synthesizing Portion under the Consideration of Damper

Figure 32:
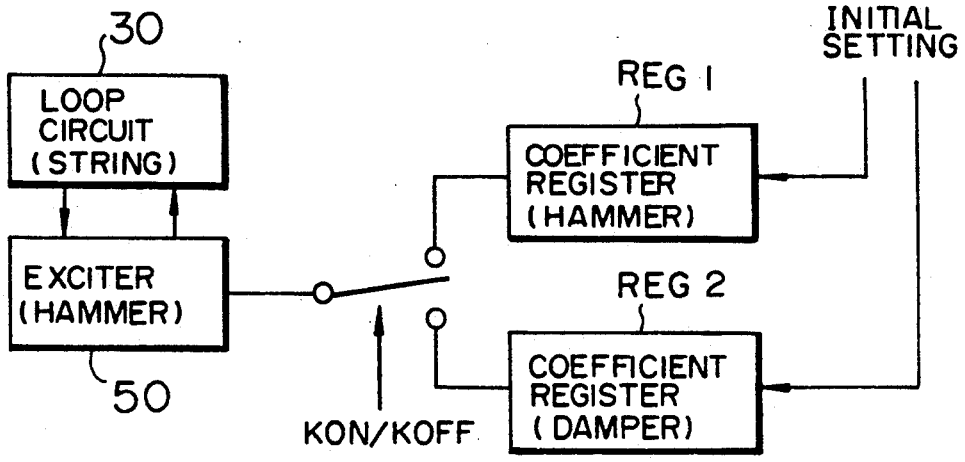
FIG. 32 is a block diagram showing the structure of model VII as a further example of the structure of the tone synthesizing portion 15.

In the real piano, string-striking due to a hammer and muting due to a damper cannot be made simultaneously. Therefore, the string-striking due to the hammer and the muting due to the damper can be simulated by using the structure of FIG. 6 through a simple operation of switching parameters such as the coefficients $-1/M$, S and R of the multipliers. A first specific example thereof is shown in FIG. 32. In the structure shown in FIG. 32, parameters corresponding to the hammer and the damper are once stored in coefficient registers REG1 and REG2 when the electric source for the electronic musical instrument is turned on or when parameters are registered newly. When the key switch signal KON/KOFF is started in response to the key-depressing operation, hammer parameters are read from the coefficient register REG1 and set to the respective portions of the excitation circuit 50 to simulate the string-striking. When the key switch signal KON/KOFF is then stopped by releasing the depressed key, damper parameters are read from the coefficient register REG2 and set to the respective portions of the excitation circuit 50 to simulate the muting due to the damper.

Figure 33:
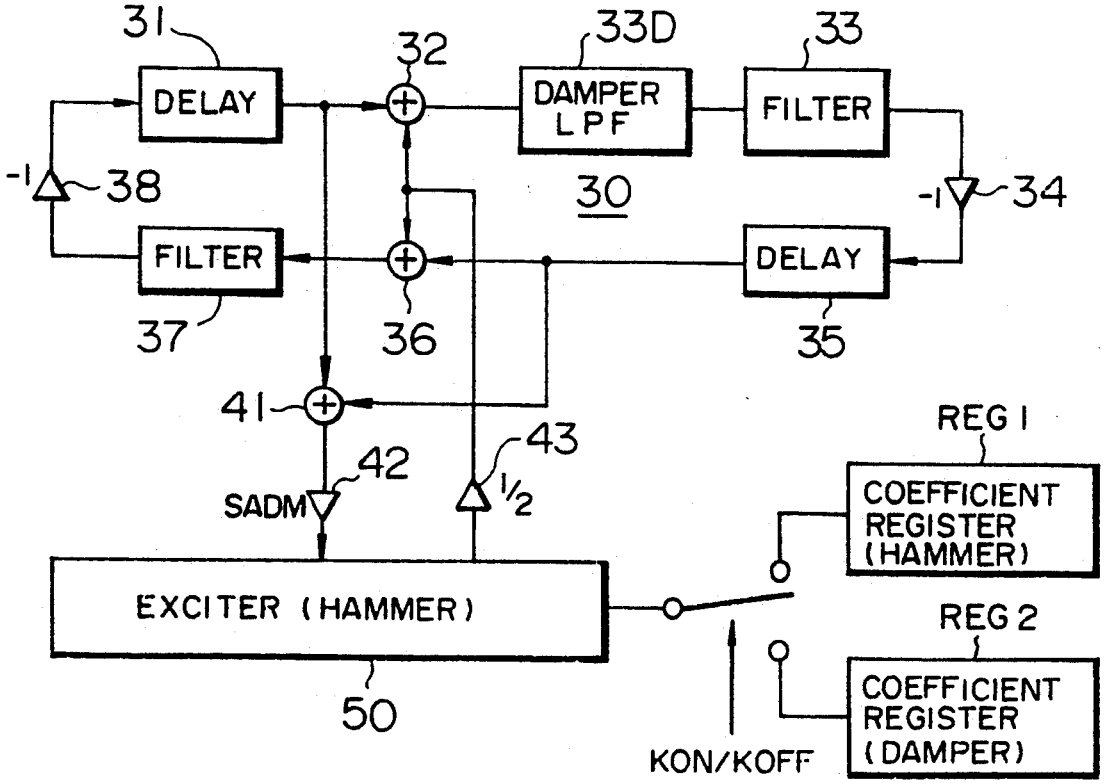
FIG. 33 is a block diagram showing another example of the structure of model VII.

A second specific example of the structure under the consideration of the damper is shown in FIG. 33. In the second specific example, a low-pass filter 33D for controlling the pass characteristic is interposed in the loop circuit 30 in addition to the first specific example. When, for example, simulation without muting is made, the low-pass filter 33D is validated so that the output from the adder 32 is directly supplied to the filter 33. When, on the contrary, the playing of the piano with muting is simulated, a predetermined filter coefficient is given to the low-pass filter 33D to simulate acoustic loss given to the string STR by the damper.

A judgment as to whether a key-releasing operation is made can be made by the key switch signal or by detecting the production of negative pulses from the acceleration pickup 24. In this case, the negative pulse signal from the acceleration pickup 24 may be directly fed, as a signal corresponding to the acceleration of the damper, to the integrator 56 in FIG. 6 after the setting of damper parameters is completed. Or a signal obtained by integrating the negative pulses may be used as the hammer velocity signal HV. By this method, muting can be controlled correspondingly to the release touch, so that a feeling of colorful key release can be attained.

STRUCTURE RELATED TO GENERATION OF MECHANICAL NOISE

When the piano is played, not only a tone generated by the vibration of the string and a tone generated by the propagation of the vibration of the string on the resonance system such as a sound-board or a piano frame are heard but so-called mechanical noise is heard. The mechanical noise is generated by the striking of the key on the stopper or by rubbing of the key on the stopper. The piano tone is more or less characterized by the mechanical noise. Accordingly, the reality of tone generation (particularly, attack portion) can be improved by simulating the mechanical noise. The mechanical noise can classified into groups, namely, direct noise, noise filtered by the resonance system, noise passing through a considerably complex course such as noise injected from the bridge into the string and then radiated, etc. That is, various types of noise can be heard to our ears.

Figure 34:
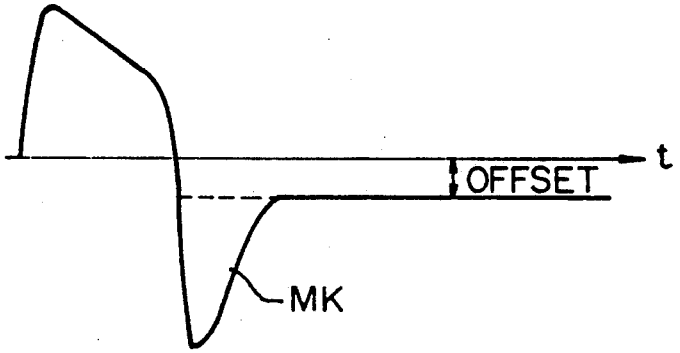
FIG. 34 is a waveform graph showing the operation of producing mechanical noise in this embodiment of the invention.
Figure 35:
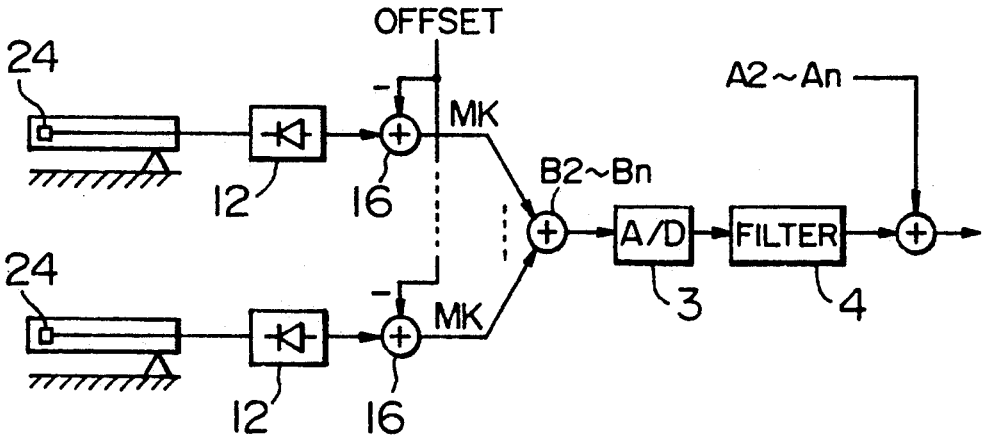
FIG. 35 is a block diagram showing an example of the structure of a portion related to the production of mechanical noise in this embodiment of the invention.
Figure 36:
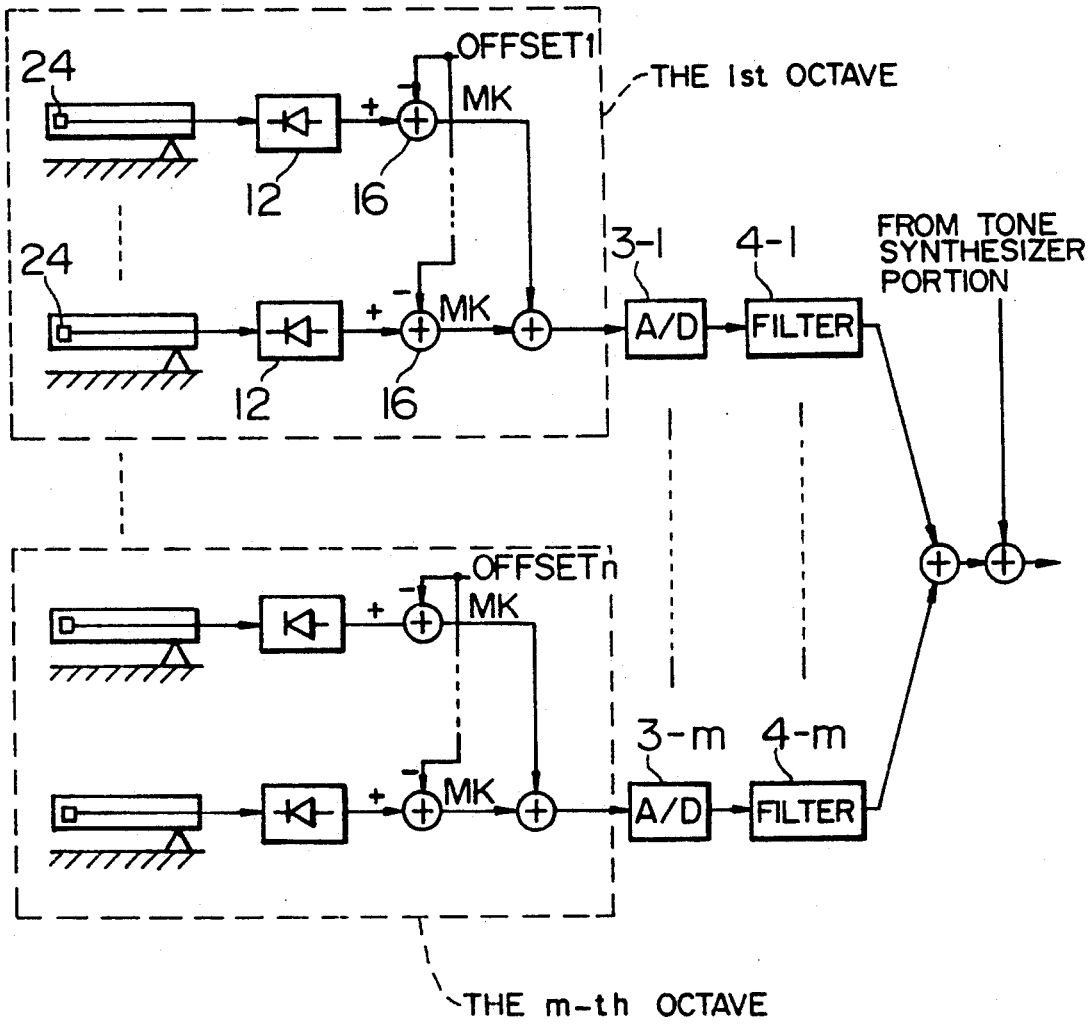
FIG. 36 is a block diagram showing another example of the structure of the portion related to the production of mechanical noise in this embodiment of the invention.

The output from the acceleration pickup 24 attached to the key is used to simulate the generation of the mechanical noise. A signal MK corresponding to the acceleration given to the stopper at the time of the striking of the key on the stopper is obtained by extracting, through the structure shown in FIG. 3 or in FIG. 9, a portion calculated by subtracting the offset OFFSET from a portion corresponding to the negative region in the output waveform of the acceleration pickup 24 as shown in FIG. 34. The signal MK thus obtained is subjected to A/D conversion and then passed through the filter 4 (FIG. 1) for approximating the characteristic of the resonance system such as a piano frame or a sound-board. Then, the resulting signal is added to the output from the tone synthesizing portion 15. In this case, it is practical from the economical viewpoint that signals MK, MK, . . . corresponding to the respective keys are added before A/D conversion as shown in FIG. 35. In the case where mechanical noise more closely resembling the mechanical noise in the real piano need be generated, a structure shown in FIG. 36 is used. In this structure, signals MK, MK, . . . are added for each octave. The results of the addition of signals MK, MK, . . . for each octave are respectively subjected to A/D conversion in the A/D converters 3-1 to 3-m (m: the number of octaves) and passed through the filters 4-1 to 4-m which are different in the characteristic thereof. The resulting signals are added to the tone signal from the tone synthesizing portion.

As another mechanical noise, string beating may be produced in strings when an impulse is given to the piano body. This is produced by injecting the vibration of the piano frame into strings through bridges. This string beating can be simulated by injecting the output of the mechanical noise generating filter 4 into a position (for example, the input terminal of the phase inversion circuit 34 in FIG. 6) corresponding to the bridge in the tone synthesizing portion 15.

Although description has been made upon the case where the signal from the acceleration pickup 24 is delivered to the filter 4, the invention can be applied to the case where a waveform corresponding to the impulse of the hammer is stored in a memory in advance so that the waveform can be read from the memory and given to the filter 4. Or pressure sensors may be attached to stoppers so that output signals from the pressure sensors can be used without use of the acceleration pickup 24. Or the waveform of mechanical noise per se may be stored in a memory in advance so that the waveform of mechanical noise can be added to the tone signal at the output stage.

RESONANCE SYSTEM

The piano tone generally heard contains not only a pure tone based on the vibration of the string but a synthesized tone obtained by folding up the vibration of the string through the sound-board, the piano frame and the like. Accordingly, it is considered that the tone signal obtained by the tone synthesizing portion 15 is given to a resonance system. The resonance system can be provided by waveguides or combination of comb filters and all-pass filters.

The resonance characteristic of the piano varies widely according to the string position. It may be therefore ideal that a plurality of resonance systems are provided correspondingly to the respective strings. This is, however, impractical from the viewpoint of the quantity of arithmetic operation. Accordingly, a method in which a signal obtained by adding tone signals corresponding to 88 keys is used as an input signal to the resonance system and a structure in which one resonance system per an octave is provided are practical. In this case, characteristic corresponding to the pitch area is used as the characteristic of each of the resonance systems. Or the resonance output may be fed back to the tone synthesizing portion 15 to simulate the connection of the string and the sound-board.

APPLICATION TO KEYBOARD ELECTRONIC MUSICAL INSTRUMENT IN WHICH ALLKEYS DO NOT HAVE CORRESPONDING TONE GENERATORS

The aforementioned keyboard electronic musical instrument is basically a full-key tone generation model (for example, 88 keys and 88 tone generators). The invention can be however applied to a keyboard electronic musical instrument in which the number of keys is different from the number of tone generators (for example, 88 keys and 16 tone generators or 88 keys and 32 tone generators). In the case of the full-key tone generation model, it is unnecessary that the CPU1 performs the recognition of key codes, the recognition of the number of generated tones, the assign of the tone generators. In the case where the model is not provided as the full-key tone generation model, tones different in pitch are generated by one tone generator. In this case, it is necessary to switch coefficients of the multi-dimensional FIR filters correspondingly to the pitch. To make this possible, results obtained by calculating filter coefficients corresponding to the respective key codes are stored in a coefficient register in advance so that the CPU 1 can read filter coefficients corresponding to the key code from the coefficient register and supplies the coefficients to a corresponding tone generator when a key on event occurs. In the case, the number of dimensions in the filters increases as the pitch based on the string becomes lower. That is, the number of dimensions in the filter for a low-pitch string is larger than a value ten times as much as the number of dimensions in the filter for a high-pitch string. Accordingly, the memory capacity can be saved by changing the capacity of the coefficient register correspondingly to the key code.

APPLICATION TO KEYBOARD ELECTRONIC MUSICAL INSTRUMENT HAVING GENERAL TONE GENERATORS

Figure 37:
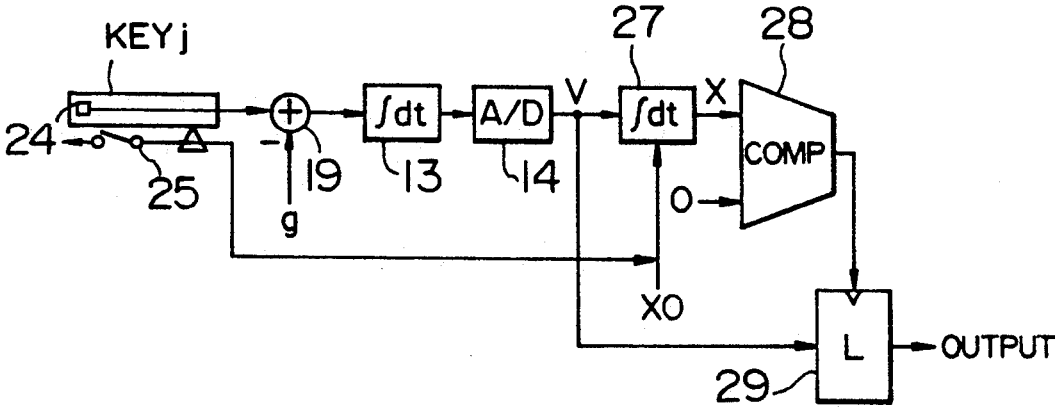
FIG. 37 is a block diagram showing an example of the structure of the electronic musical instrument in the case where this invention is applied to a keyboard electronic musical instrument having a general tone generator or to an MIDI tone generator.
Figure 38:
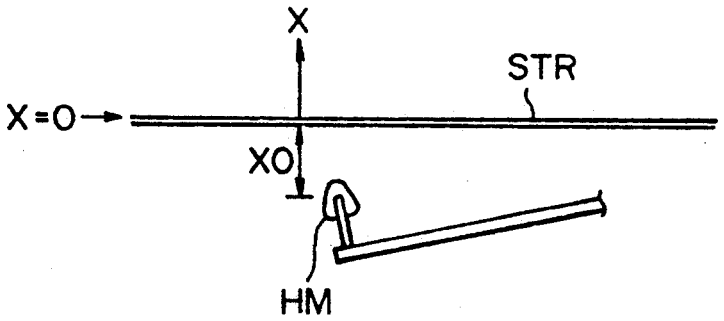
FIG. 38 is a diagram showing piano hammer HM simulated by the structure of FIG. 37.
Figure 39:
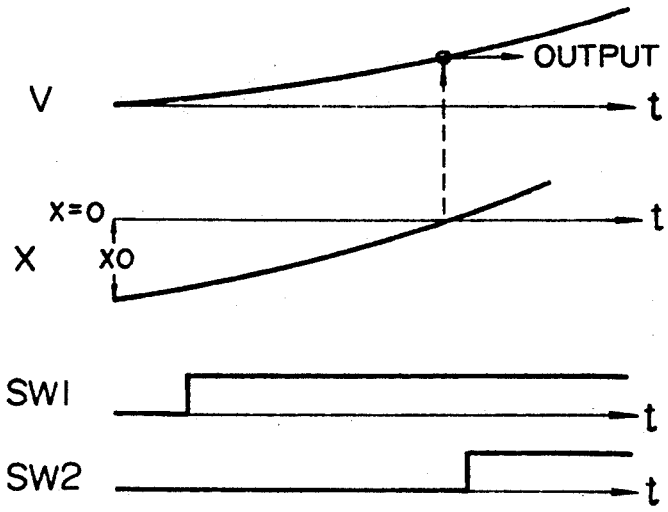
FIG. 39 is a waveform graph showing the comparison between the operation of the structure of FIG. 37 and the operation of the conventional structure.
Figure 40:
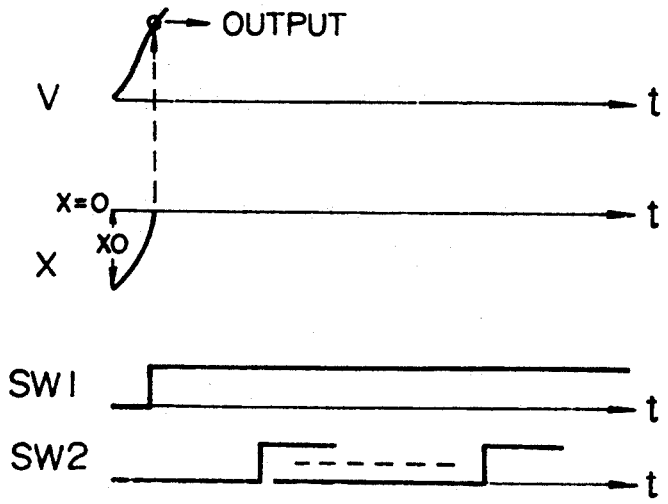
FIG. 40 is a waveform graph showing the comparison between the operation of the structure of FIG. 37 and the operation of the conventional structure.

This invention can be applied to a keyboard electronic musical instrument having general tone generators such as FM tone generators, waveform reading type tone generators, and the like. An example of the structure thereof is shown in FIG. 37. In this structure, the substracter 19 subtracts a signal g corresponding to gravity acceleration from the acceleration detection signal outputted from the acceleration pickup 24. The resulting signal is integrated by the integrator 13. The output from the integrator 13 is given to the A/D converter 14, so that a signal V expressing the velocity of the hammer HM as shown in FIG. 38 is delivered from the A/D converter 14 to the integrator 27 and the latch 29. Here, the integrator 27 is initialized to a signal value X0 corresponding to the initial displacement between the hammer HM and the string STR in FIG. 38 by turning on the switch 25 in response to the starting of key depression. Then, the signal V is integrated by the integrator 27, so that the integration result, that is, a signal X expressing the displacement of the hammer HM, is given to the comparator 28. Then, as shown in FIGS. 39 and 40, when the signal X reaches the value X0 corresponding to the stationary position of the string STR (that is, when the hammer HM strikes on the string STR), the output from the comparator 28 is started. As a result, the signal V at the present point of time is fetched in the latch 29 and then supplied, as a velocity signal, to the tone generator such as an FM tone generator. It is a matter of course that the velocity signal can be supplied to an MIDI tone generator.

Figure 41:
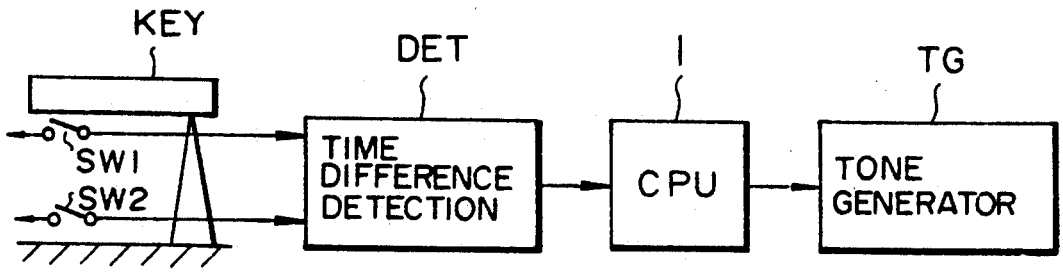
FIG. 41 is a block diagram showing the structure of a conventional keyboard electronic musical instrument.

The operation of this structure and the operation of a structure (FIG. 41) using conventional switches SW1 and SW2 will be compared to each other with reference to FIGS. 39 and 40 in the case where a key is depressed slowly and deeply and in the case where a key is depressed rapidly. In the case where a key is depressed slowly and deeply, the switch SW2 is securely turned on as shown in FIG. 39. Accordingly, key velocity can be detected by detecting the time difference between the turning-on of the switch SW1 and the turning-on of the switch SW2. In the case where a key is depressed rapidly, the key may be returned before the switch SW2 is turned on. Accordingly, the turning-on of the switch SW2 cannot often be detected though the turning-on of the switch SW1 can be detected. Even in the case where the switch SW2 is turned on, the timing of turning the switch SW2 on may be unstable or delayed as shown in FIG. 40. In this structure according to the invention, the behavior of the hammer HM in response to the key depression is faithfully simulated, so that key-depressing touch can be accurately reflected on the velocity signal. Further, in this structure, when the key-depressing speed is high, the signal X is started very rapidly is shown in FIG. 40. Accordingly, the velocity signal can be generated before the key is depressed deeply (which corresponds to the point of time when the switch SW2 is turned on in the conventional structure). As a result, there arises an advantage that good response to rapid key depression can be provided.

What is claimed is:

1. An electronic musical instrument comprising:

a manipulator manipulated by a performer;

control signal generating means for generating a control signal in response to manipulation of said manipulator;

an acceleration detector means disposed in said manipulator for generating an acceleration signal corresponding to acceleration action on said manipulator;

an integration means for integrating said acceleration signal with respect to time and generating a velocity signal calculated in response to said control signal; and a tone synthesizing means for synthesizing a musical tone on the basis of said velocity signal.

2. An eletronic musical instrument according to claim 1, wherein: said manipulator is constituted by a keyboard having a plurality of keys; and said acceleration detector means includes acceleration sensors respectively connected to said plurality of keys.

3. An electronic musical instrument according to claim 2, wherein said acceleration detector means includes means for detecting acceleration only in one direction.

4. An electronic musical instrument according to claim 3, wherein said acceleration detector means further includes means for detecting acceleration in the reverse direction.

5. An electronic musical instrument according to claim 2, wherein said acceleration detector means further includes means for detecting key depression/-release.

6. An electronic musical instrument according to claim 5, wherein said key depression/release detecting means controls the operation of said integration means.

7. An electronic musical instrument according to claim 1, wherein said tone synthesizer means includes a loop circuit for simulating the action of a string, and an excitation circuit for giving an excitation signal to said loop circuit.

8. An electronic musical instrument according to claim 7, wherein said excitation circuit includes a first integration circuit for generating a manipulator position signal by integrating said velocity signal with respect to time.

9. An electronic musical instrument according to claim 8, wherein said excitation circuit includes a second integration circuit for generating a string position signal by integrating the output signal from said loop circuit with respect to time.

10. An electronic musical instrument according to claim 9, wherein said excitation circuit includes a subtraction circuit connected both to the output of said first excitation circuit and to the output of said second excitation circuit to generate a relative manipulator position signal corresponding to said string position signal.

11. An electronic musical instrument according to claim 1 further comprising:

extracting means for extracting a negative component of the acceleration signal;

subtracting means for subtracting a predetermined value from a signal outputted from said extracting means.

12. An electronic musical instrument comprising:

a manipulator manipulated by a performer;

control signal generating means for generating a control signal in response to manipulation of said manipulator;

an acceleration detector means disposed in said manipulator for generating an acceleration signal corresponding to acceleration action on said manipulator;

an integration means for integrating said acceleration signal with respect to time and generating a velocity signal calculated in response to said control signal; and a tone synthesizer means for synthesizing a musical tone on the basis of said velocity signal, said tone synthesizer means including a loop circuit for circulating a signal, said loop circuit including a delay means for giving a delay time to a signal circulating in the loop corresponding to the pitch of a musical tone to be synthesized, and an output wherein the terminal for picking up a signal circulated in the loop circuit from the closed loop circuit as a musical tone, and excitation means for creating an excitation signal in response to an output of the loop circuit and the velocity signal and supplying the created excitation signal into the loop circuit.

13. An electronic musical instrument according to claim 12 further comprising:

second loop circuit for circulating a signal, said second loop circuit including delay means for giving a delay time to a signal circulating in said second loop, the delay time determining a characteristic of a musical tone to be synthesized, wherein the signal circulated in the loop circuit is picked up from the loop circuit as a musical tone signal;

multiplying means connected between the excitation means and the second loop circuit for squaring the excitation signal outputted from the excitation means and for outputting the squared signal to the second loop circuit.

14. An electronic musical instrument according to claim 13 wherein said delay means determines a pitch of the musical tone to be synthesized.

15. An electronic musical instrument according to claim 13 further comprising:

second multiplying means connected between the loop circuit and the second loop circuit for squaring output signal outputted from the loop circuit and for supplying the squared signal to the second loop circuit.

* * * * *